US006695327B1

(12) United States Patent
Maggiore et al.

(10) Patent No.: US 6,695,327 B1
(45) Date of Patent: Feb. 24, 2004

(54) CONVERTIBLE WALKING AND RIDING DEVICE AND METHOD OF USING THE SAME

(75) Inventors: Albert P. Maggiore, Lancaster, NY (US); Carol D. Snyder, East Aurora, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/134,642

(22) Filed: Apr. 30, 2002

(51) Int. Cl.[7] ..... B62B 7/04

(52) U.S. Cl. ..... 280/87.051; 280/648; 280/1.16

(58) Field of Search ..... 280/87.01, 87.021, 280/87.05, 87.051, 638, 38, 642, 643, 646, 648, 650, 658, 47.38, 828, 1.16, 1.165, 1.188, 30; 446/465, 470; D21/424, 425, 426; 297/5, 6

(56) References Cited

U.S. PATENT DOCUMENTS

| | | | | |
|---|---|---|---|---|
| 408,635 | A | 8/1889 | Sommer | |
| 621,061 | A | 3/1899 | Gay | |
| 1,347,384 | A | 7/1920 | Kinnard | |
| 1,570,410 | A | 1/1926 | Strauss | |
| 1,769,327 | A | 7/1930 | Wood | |
| 1,981,285 | A | 11/1934 | Rechlicz | |
| 2,179,275 | A | 11/1939 | Sacheroff | |
| 2,375,389 | A | 5/1945 | Shuler | |
| 2,415,146 | A | 2/1947 | Nanna | |
| 2,471,004 | A | 5/1949 | Moster | |
| 2,481,837 | A | 9/1949 | Giese | |
| D156,390 | S | 12/1949 | Wenpetren | |
| 2,634,791 | A | 4/1953 | Weirich | |
| 2,869,613 | A | 1/1959 | Parker | |
| 2,917,864 | A | 12/1959 | Payne | |
| 2,986,400 | A | 5/1961 | Phillips | |
| 3,504,927 | A | 4/1970 | Seki | |
| 3,692,359 | A | 9/1972 | Boucher | |
| 4,052,082 | A | 10/1977 | Jones et al. | |
| 4,123,078 | A | 10/1978 | Murakami | |
| D252,652 | S | 8/1979 | Nakao et al. | |
| 4,261,588 | A | 4/1981 | Kassai | |
| 4,300,783 | A | 11/1981 | Fisher | |
| D262,385 | S | 12/1981 | Nakao et al. | |
| 4,540,192 | A | 9/1985 | Shelton | |
| D285,949 | S | 9/1986 | Thomson et al. | |
| 4,925,329 | A * | 5/1990 | Chuang | 403/93 |
| D320,239 | S | 9/1991 | Kassai | |
| 5,224,731 | A | 7/1993 | Johnson | |
| 5,362,272 | A | 11/1994 | Chow et al. | |
| D353,566 | S | 12/1994 | Chow et al. | |
| D358,791 | S | 5/1995 | Cacciola et al. | |
| 5,441,289 | A | 8/1995 | Spielberger | |

(List continued on next page.)

FOREIGN PATENT DOCUMENTS

| | | |
|---|---|---|
| GB | 113661 | 3/1918 |

*Primary Examiner*—Brian L. Johnson
*Assistant Examiner*—Brian L Swenson
(74) *Attorney, Agent, or Firm*—Cooley Godward LLP

(57) ABSTRACT

A convertible toy walking or riding device or mechanism includes a body portion and a seat portion coupled to the body portion. The seat portion is moveable relative to the body portion to position the device in a walking configuration or in a riding configuration for use by a child.

31 Claims, 17 Drawing Sheets

U.S. PATENT DOCUMENTS 5,474,483 A * 12/1995 Sun ..... 446/71
5,538,267 A 7/1996 Pasin et al.
5,558,358 A 9/1996 Johnson
5,692,760 A 12/1997 Pickering
5,741,020 A 4/1998 Harroun
5,788,253 A 8/1998 Thomson et al.
6,036,604 A 3/2000 Klitsner
D424,126 S 5/2000 Goes et al.
6,056,620 A 5/2000 Tobin
6,089,586 A 7/2000 Rudell et al.
6,161,847 A 12/2000 Howell et al.
6,206,384 B1 3/2001 Chi et al.
6,231,056 B1 5/2001 Wu
6,296,268 B1 10/2001 Ford et al.
6,350,171 B1 2/2002 Hippely et al.
6,485,039 B1 * 11/2002 Ming-Fu ..... 280/87.041

* cited by examiner

CONVERTIBLE WALKING AND RIDING DEVICE AND METHOD OF USING THE SAME

BACKGROUND OF THE INVENTION

This invention relates to a toy moving device, and in particular, to a convertible walking and riding device and a method of using the device.

There are many types of conventional toy walking or riding devices. Conventional toy walking devices are usually designed for a single mode of use, such as to provide support for a child that is walking. Such walking devices typically do not include a seat or support area on which a child may sit.

Conventional toy riding devices are also usually designed for a single mode of use. Such riding devices usually include a handle and a seat-like structure located behind the handle. The seat-like structure is usually located behind the handle such that a child cannot simultaneously hold on to the handle and walk.

Some toy riding devices include moveable parts that enable the device to be used in different configurations. For example, a child may use a riding device in a standing position (such as on a scooter) or in a seated position (such as on a tricycle). However, many of these toy riding devices are usually difficult to convert between different configurations. Moreover, the moveable parts of these devices do not move sufficiently to provide a walking area to enable a small child to use the riding device in a stable walking mode.

A need exists for a toy walking and riding device that is easily convertible from a stable walking configuration to a riding configuration.

SUMMARY OF THE INVENTION

A convertible toy walking and riding device includes a front portion and a seat portion coupled to the front portion. The seat portion is moveable relative to the front portion between several positions. In one position, the seat portion and the front portion form a walking configuration. In another position, the seat portion and the front portion form a riding configuration. In one embodiment, the seat portion is pivotally coupled to the front portion. In another embodiment, the seat portion is slidably coupled to the front portion.

In one embodiment, the seat portion is a single member. In an alternative embodiment, the seat portion includes two seat members that are moveable relative to each other and relative to the front portion.

The front portion is supported on one or more wheels for movement on a support surface. Similarly, the seat portion is supported on one or more wheels. In one embodiment, the walking and riding device has an entertainment portion that includes an output generating system and several play components, such as balls mounted on a track. The output generating system can be user activated and/or motion activated.

DETAILED DESCRIPTION OF THE INVENTION

A convertible toy walking and riding device includes a front portion and a seat portion coupled to the front portion. The seat portion is moveable relative to the front portion between several positions. In one position, the seat portion and the front portion form a walking configuration. In another position, the seat portion and the front portion form a riding configuration. In one embodiment, the seat portion is pivotally coupled to the front portion. In another embodiment, the seat portion is slidably coupled to the front portion.

In one embodiment, the seat portion is a single member. In an alternative embodiment, the seat portion includes two seat members that are moveable relative to each other and relative to the front portion.

The front portion is supported on one or more wheels for movement on a support surface. Similarly, the seat portion is supported on one or more wheels. In one embodiment, the walking and riding device has an entertainment portion that includes an output generating system and several play components, such as balls mounted on a track. The output generating system can be user activated and/or motion activated.

Figure 1:
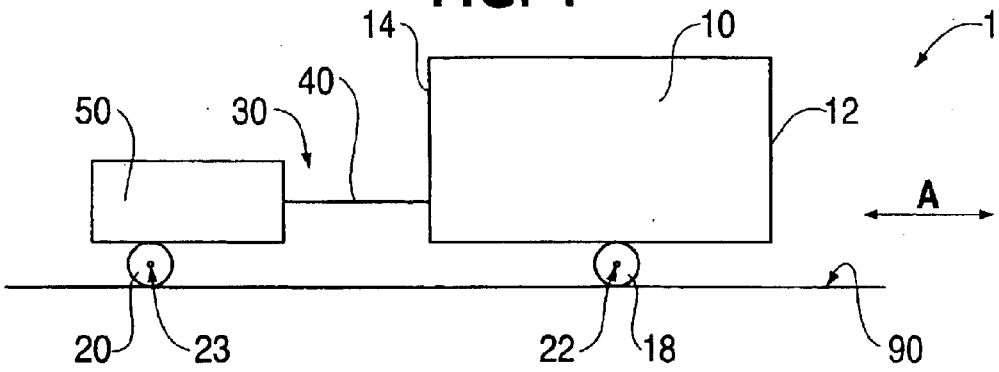
FIG. 1 illustrates a schematic side view of an embodiment of a convertible walking and riding device in accordance with the present invention.
Figure 2:
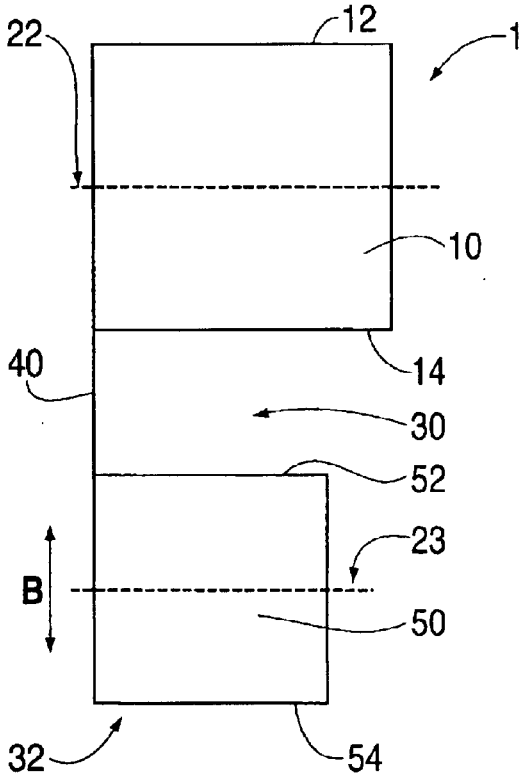
FIG. 2 illustrates a schematic top view of the device of FIG. 1 in a walking configuration.
Figure 3:
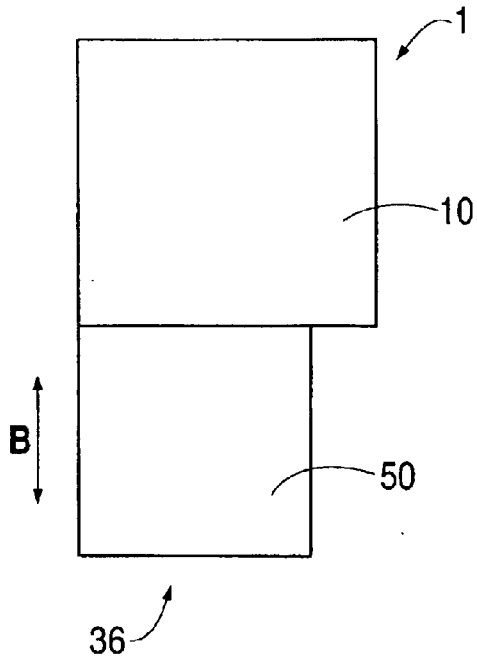
FIG. 3 illustrates a schematic top view of the device of FIG. 1 in a riding configuration.

An embodiment of a convertible walking and riding device in accordance with the present invention is illustrated in FIGS. 1–3. The device 1 includes a body portion or front portion 10 and a seat or seat portion 50. The front portion 10 may be referred to as a chassis. The seat portion 50 is coupled to the front portion 10. The front portion 10 includes upper and lower surfaces and a forward end 12 and a rearward or back end 14. Similarly, the seat portion 50 includes a forward end 52 and a rearward end 54.

As illustrated, the front portion 10 and the seat portion 50 can be spaced apart to define a walking area 30 therebetween. A child may stand in the walking area 30 and hold onto the front portion 10 of the device 1.

In the illustrated embodiment, the seat portion 50 is coupled to the front portion 10 by connector 40. Connector 40 enables the seat portion 50 to move relative to the front portion 10. Connector 40 may be any conventional type of connector that can couple the seat portion 50 and the front portion 10 together. In one embodiment, connector 40 may be a single member that is fixedly coupled to either the front portion 10 or the seat portion 50 and movably coupled to the other. In an alternative embodiment, connector 40 may include two members slidably coupled to each other and fixedly coupled to one of the body and seat portions.

The device 1 includes a front wheel 18 and a rear wheel 20. The front wheel 18 is mounted on an axle (not shown) and has an axis of rotation 22. Similarly, the rear wheel 20 is mounted on an axle (not shown) and has an axis of rotation 23. The front and rear wheels 18 and 20 support the front and seat portions 10 and 50, respectively, for movement along a support surface 90 forward or backward along the directions of arrow "A." In alternative embodiments, the device 1 may have two or more front and/or rear wheels.

In the illustrated embodiment, the device 1 is selectively disposable in multiple configurations, including a first configuration 32 (see FIG. 2) and a second configuration 36 (see FIG. 3). The first configuration 32 can be referred to as a walking configuration. In the walking configuration, the seat portion 50 is spaced apart from the front portion 10 along the direction of arrow "B" to provide a walking area 30. A child can stand in the walking area 30, pull himself up, and hold on to the front portion 10 and use the device 1 to walk.

The second configuration 36 can be referred to as a riding configuration. In the riding configuration, the seat portion 50 is positioned proximate to the front portion 10. As illustrated, the front surface 52 of the seat portion 50 is placed proximate to the rear surface 14 of the front portion 10. In this configuration, a child can sit on the seat portion 50 and hold onto the front portion 10. In order to move the device 1, the occupant can use his feet to propel the device 1 either forward or backward along the support surface 90.

In this embodiment, connector 40 is located adjacent to a side of the front portion 10 and to a side of the seat portion 50. In alterative embodiments, connector 40 may be located anywhere along these portions, such as proximate to the centers of the portions.

Figure 4:
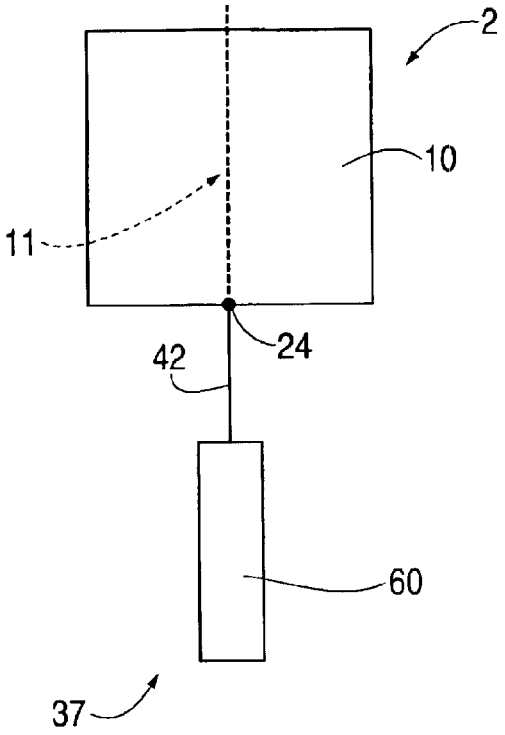
FIG. 4 illustrates a schematic top view of another embodiment of a convertible device in a riding configuration in accordance with the present invention.
Figure 5:
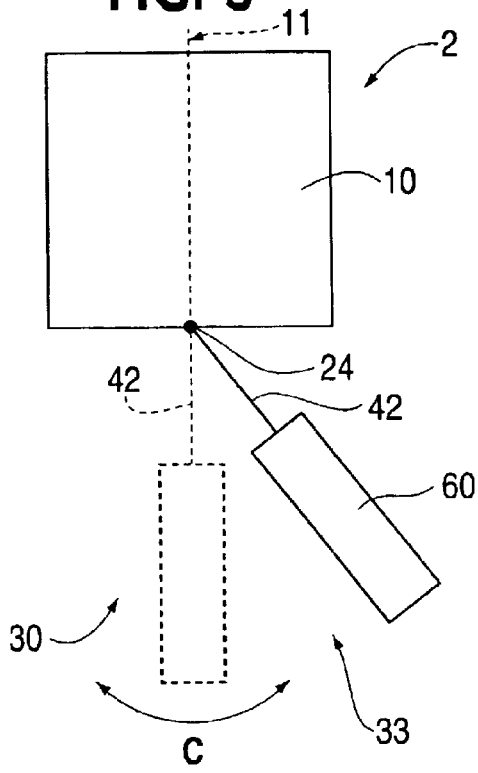
FIG. 5 illustrates a schematic top view of the device of FIG. 4 in a walking configuration.

An alternative embodiment of a convertible device is illustrated in FIGS. 4 and 5. Device 2 includes a front portion 10 and a seat portion 60. Front portion 10 is similar to the front portion 10 described relative to FIGS. 1–3. The seat portion 60 is moveable relative to the front portion 10, thereby enabling the device 2 to be disposed in multiple configurations.

The front portion 10 has a center line 11 that extends along the same direction as the travel of the device 1. The front portion 10 is coupled to the seat portion 60 by connector 42. Connector 42 is coupled to the front portion 10 at connection point 24, which in this embodiment, is located along the center line 11. Device 2 is illustrated in a riding configuration 37 in FIG. 4.

As illustrated in FIG. 5, the connector 42 is pivotally coupled to the front portion 10 at pivot point 24. The connector 42 and the seat portion 60 can be rotated about point 24 along the directions of arrow "C" to several different positions. For example, the seat portion 60 can be moved to a first position aligned with the center line 11 (as illustrated in FIG. 4 and as illustrated in phantom in FIG. 5) corresponding to a riding configuration 37 of the device 2. The seat portion 60 can also be moved to a second position offset from the center line 11 (as illustrated in FIG. 5). In this position, a walking area 30 is formed and the device 2 is in a walking configuration 33.

Figure 6:
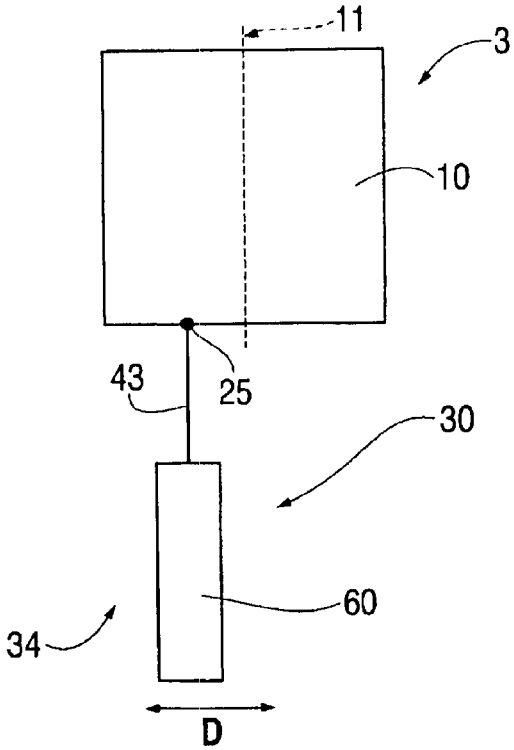
FIG. 6 illustrates a schematic top view of another embodiment of a convertible device in a walking configuration.

An alternative embodiment of a convertible device is illustrated in FIG. 6. The front portion 10 and seat portion 60 of the device 3 are similar to those of device 2 described relative to FIGS. 4 and 5.

In this embodiment, the seat portion 60 is slidably coupled to the front portion 10. In particular, the connector 43 is coupled to the front portion 10 at connection point 25 by a conventional sliding coupling. The connection point 25 and the connector 43 are moveable side to side along the directions of arrow "D" as illustrated in FIG. 6. When the seat portion 60 is moved offset from center line 11 to its position shown in FIG. 6, the device 3 is in a walking configuration 34 and a walking area 30 is formed behind the front portion 10.

Figure 7:
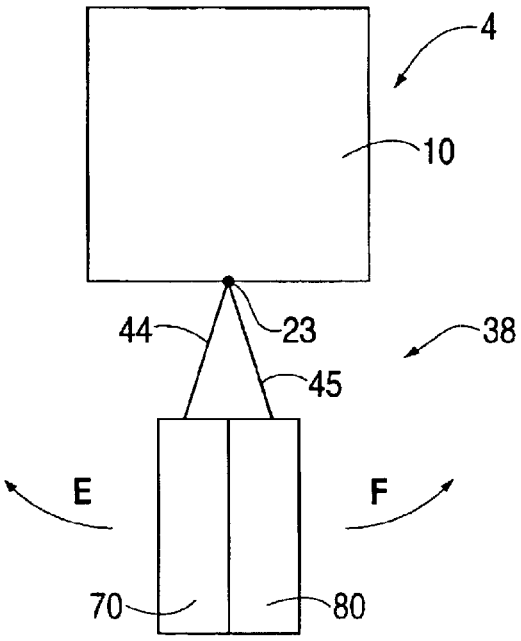
FIG. 7 illustrates a schematic top view of another embodiment of a convertible device in a riding configuration.

Another embodiment of a convertible device is illustrated in FIG. 7. In this embodiment, the device 4 includes a front portion 10 and two seat portions 70 and 80 coupled to the front portion 10.

The seat portions 70 and 80 are coupled to the front portion 10 by connectors 44 and 45, respectively. Connectors 44 and 45 are coupled to the front portion 10 at a common pivot joint or point 23. The seat portions 70 and 80 are moveable about pivot point 23 along the directions of arrows "E" and "F", respectively. When the seat portions 70 and 80 are proximate to each other, they form a seating surface and the device 4 is in a riding configuration 38. When the seat portions 70 and 80 are moved apart, a walking area 30 is formed between them and the device 4 is in a walking configuration.

Figure 8:
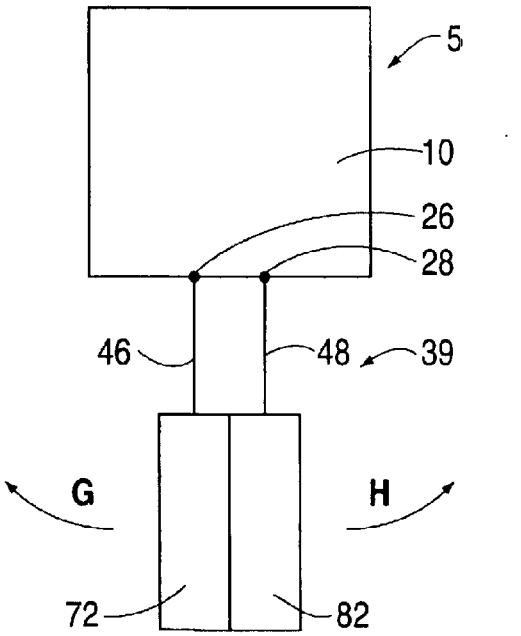
FIG. 8 illustrates a schematic top view of another embodiment of a convertible device in a riding configuration.
Figure 9:
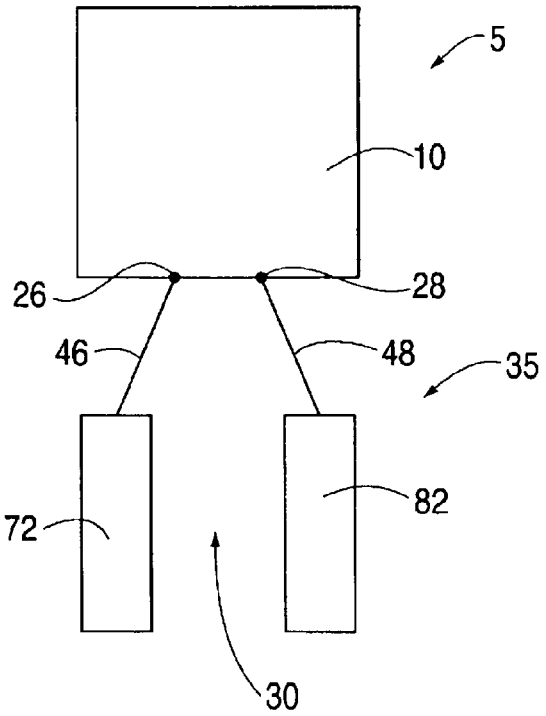
FIG. 9 illustrates a schematic top view of the device of FIG. 8 in a walking configuration.

Another embodiment of a convertible device is illustrated in FIGS. 8 and 9. The device 5 includes a front portion 10 and seat portions 72 and 82. In this embodiment, seat portions 72 and 82 are coupled to the front portion 10 by connectors 46 and 48, respectively. In particular, connector 46 is coupled to front portion 10 at connection point 26 and connector 48 is coupled to front portion 10 at connection point 28.

The seat portions 72 and 82 are disposable in several positions relative to the front portion 10. In particular, seat portions 72 and 82 can be moved proximate to each other in the positions illustrated in FIG. 8. In this arrangement, the seat portions 72 and 82 form a surface on which a child may sit when the device 5 is in its riding configuration 39.

The connectors 46 and 48 are movable about points 26 and 28 along the direction of arrows "G" and "H," respectively, to their positions illustrated in FIG. 9. In this arrangement, the device 5 is in a walking configuration 35 and a walking area 30 is formed between the two spaced apart seat portions 72 and 82.

Figure 10:
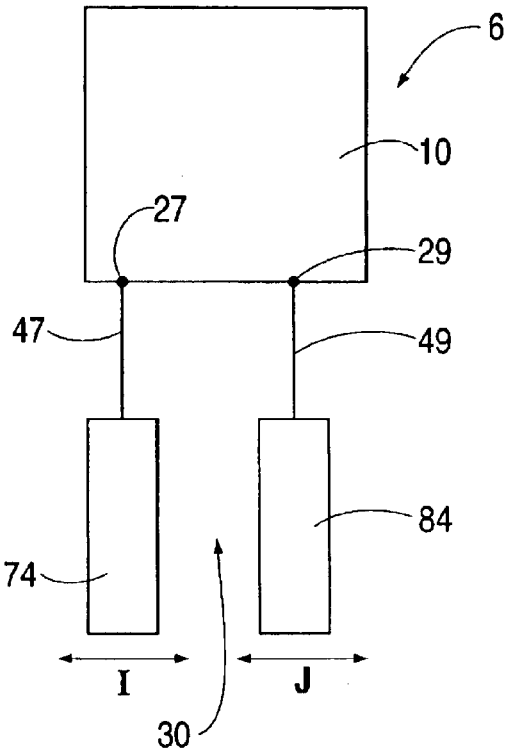
FIG. 10 illustrates a schematic top view of another embodiment of a convertible device in a walking configuration.

Another embodiment of a convertible device is illustrated in FIG. 10. In this embodiment, the device 6 includes a front portion 10 and seat portions 74 and 84. The seat portions 74 and 84 are coupled to the front portion 10 by connectors 47 and 49, respectively. Connector 47 is coupled to connection point 27 and connector 49 is coupled to connection point 29.

As illustrated in FIG. 10, connection points 27 and 29 are moveable along the directions of arrows "I" and "J." When the seat portions 74 and 84 are moved apart into their positions as illustrated in FIG. 10, a walking area 30 is formed between them.

Figure 11:
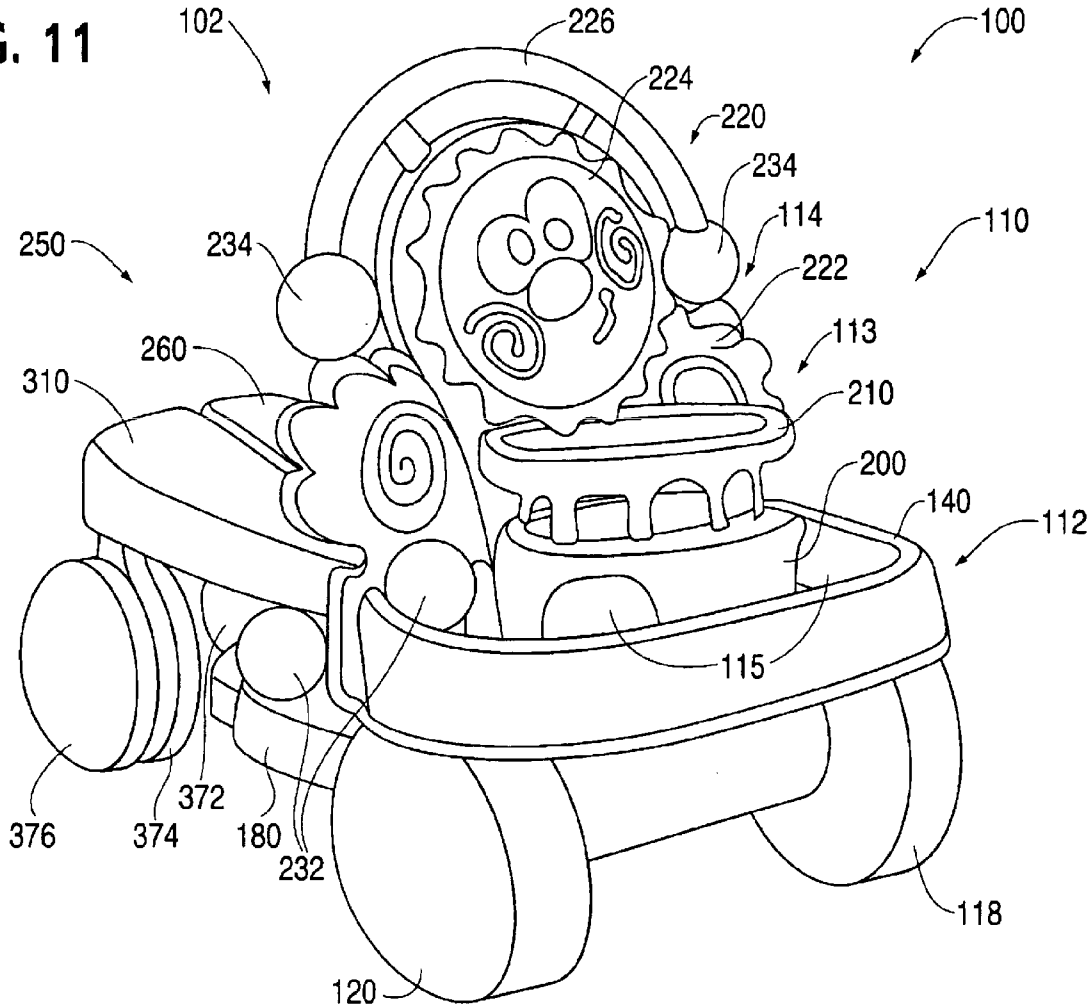
FIG. 11 illustrates a front perspective view of an embodiment of a convertible device in accordance with the present invention.

An embodiment of a convertible walking and riding device in accordance with the present invention is illustrated in FIGS. 11–44. In FIG. 11, the device 100 is illustrated in a riding or ride-on configuration 102. The device 100 includes a body portion or front portion 110 and a seat or seat portion 250 coupled to the front portion 110. The front portion 110 may be referred to as a chassis.

The front portion 110 of the device 100 is supported on front wheels 118 and 120. The front portion 110 has a forward end 112 and a rearward or back end 114. The seat is coupled to the rearward end 114 of the front portion 110.

The front portion 110 includes an upper housing 140 and a lower housing 180. The front portion 110 includes an upper housing insert 200 disposed on the upper housing 140. The front portion 110 also includes a basket 210 mounted on the upper housing insert 200. The upper housing 140, the basket 210, and the upper housing insert 200 form a container 113 for objects (such as balls, etc.). Each of the components includes an upper surface and several openings that form part of a pathway 115 for the balls or other objects.

The device 100 includes an entertainment portion 220 mounted on the upper housing 140. The entertainment portion 220 includes a sensory output generator or an output generating system (not illustrated). The output generating system can generate audible outputs including music and sound effects, as well as visible outputs including the illumination of lights. The entertainment portion 220 includes several actuators including a motion-activated switch that is activated in response to movement of the device by the user and a contact switch (such as a nose of a character on the entertainment portion) that can be pressed by the user. The output generating system can generate any output in response to activation of an actuator.

The entertainment portion 220 includes a housing 222 and a plate 224 with several lights that can be illuminated. The entertainment portion 220 also includes an upwardly extending handle 226 on which balls 234 are slidably mounted. Several balls 232 are loosely associated with the device 100 and can be placed by a child into the upper housing 140, the insert 200, or the basket 210.

In the illustrated embodiment, the seat 250 includes two seat portions 260 and 310. Seat portion 260 is supported by rear wheels 370 and 372 and seat portion 310 is supported by rear wheels 374 and 376. In alternative embodiments, the shape and configuration of the rear wheels may vary. For example, each pair of rear wheels may be replaced by a caster.

Figure 12:
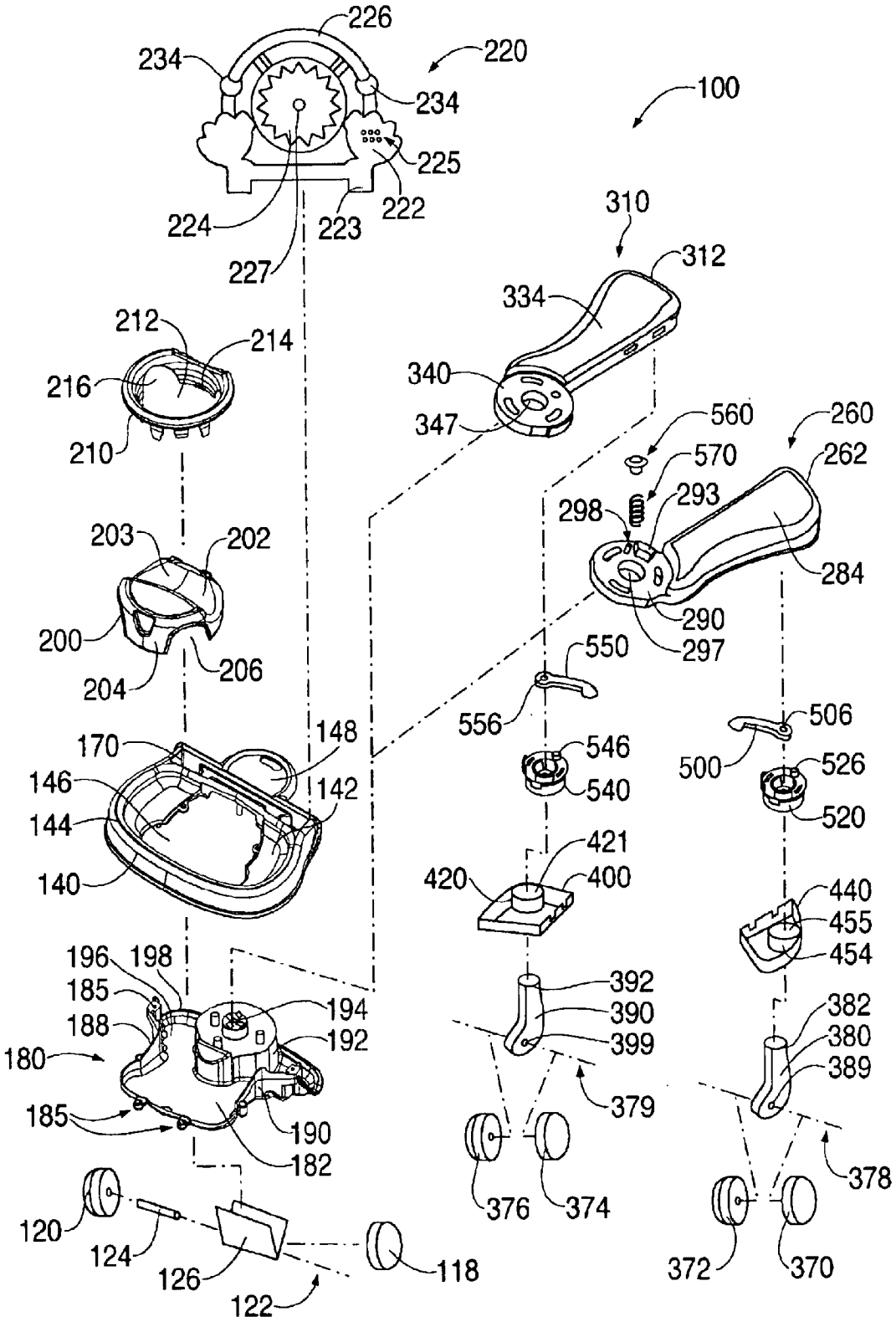
FIG. 12 illustrates an exploded front perspective view of the device of FIG. 11.

An exploded perspective view of some of the components of the convertible device 100 are illustrated in FIG. 12. As discussed above, device 100 includes an upper housing 140, a lower housing 180 coupled to the upper housing 140, and an entertainment portion 220 that is supported on the upper housing 140. The housings 140 and 180 and the entertainment portion 220 form the front portion 110 of the device 100.

The upper housing 140 includes a body 142 with an upper surface, a lower surface, and a rim 144 extending around its perimeter. The body 142 of the upper housing 140 defines an opening 146. The upper housing 140 includes a plate 148 extending rearwardly from the rear surface of the upper housing 140. The rim 144 includes a mounting opening 170 that receives a portion of the entertainment member 220, as described in greater detail below.

The lower housing 180 includes a plate 182 with side walls 188 and 190. The lower housing 180 also includes several mounting elements 185 with openings into which conventional fasteners, such as screws, can be inserted to couple the housings 140 and 180 together. The lower housing 180 includes a support mount 192 that has an extension 194 that functions as a pivot joint. When the upper housing 140 and the lower housing 180 are coupled together, the perimeter of the plate 148 is directly aligned above the perimeter of the support mount 192.

In the illustrated embodiment, the front portion of the device 100 is supported by front wheels 118 and 120. An axle mount 126 is coupled to the lower surface of the lower housing 180. The front wheels 118 and 120 are mounted on an axle 124 that is supported by the axle mount 126. The front wheels 118 and 120 rotate about an axis of rotation 122. In this embodiment, the axis of rotation 122 is fixed with respect to the front portion 110. The axle mount 126 may be any structure that can retain the axle in a particular position and orientation and permit the rotation of the axle or rotation of the wheels on the axle.

The entertainment portion 220 of the device 100 includes an output housing 222, an upper housing insert 200, and a basket 210. Each of these components is supported on the tipper housing 140.

The upper housing insert 200 is substantially circular and includes an upper surface 202 and a side wall 204. The upper surface 202 has tapered portions 203. The side wall 204 includes openings 206 through which a ball or other object can pass.

The basket 210 is substantially circular and defines a central opening 212. The basket 210 includes a side wall 214 with several openings 216 through which a ball can pass. The contour and openings of the upper housing insert 200, the basket 210, and the tipper surface of the upper housing 140 form several pathways along which a ball or other object can travel. The upper surface 184 of the lower housing 180 (see FIG. 15) also forms part of the pathway that can guide the ball or object into a receiving or retaining portion or area 196 defined by retaining wall 198.

The output housing 222 includes a mounting base 223 that is inserted into the mounting opening 170 on the upper housing 140 to support the output housing 222. The housing 222 includes several openings 225 positioned proximate to a speaker located within housing 222. The housing 222 also includes a plate 224 which may include a variety of output devices, such as lights, and a handle 226.

Turning to the seat 250 of the device 100, the seat 250 includes a first seat portion 260 and a second seat portion 310. The seat portions 260 and 310 are moveable relative to each other into positions forming a walking configuration and a riding configuration for the device 100.

In the illustrated embodiment, the first seat portion 260 includes a body 262 having a support portion 284 and a coupling plate 290. The coupling plate 290 includes a central opening 297. The coupling plate 290 is placed on the upper surface of the support mount 192 and the extension 194 is inserted into the central opening 297. In this arrangement, the first seat portion 260 is rotatably mounted on the extension 194.

The coupling plate 290 also includes a post 298 on which a spring 570 and a button 560 can be positioned. The function and stricture of the spring 570 and the button 560 are discussed in detail below. The coupling plate 290 includes an arcuate shaped block 293 located adjacent to post 298.

The second seat portion 310 includes a body 312 having a support portion 334 and a coupling plate 340. The coupling plate 340 includes a central opening 347. When the device 100 is assembled, the coupling plate 340 is located on top of the coupling plate 290 of the first seat portion 260. The opening 347 on coupling plate 340 also receives the extension 194 on support mount 192 and the second seat portion 310 is mounted for rotation about the extension 194.

As illustrated in FIG. 12, the device 100 includes a pair of wheel mounts 380 and 390. Wheel mount 380 includes an upper end 382 and an opening 389. Similarly, wheel mount 390 includes an upper end 392 and an opening 399.

Rear wheels 370 and 372 are mounted on an axle (not shown) that is inserted into the opening 389 on wheel mount 380. Rear wheels 370 and 372 are mounted for rotation about axis 378. Similarly, rear wheels 374 and 376 are mounted on an axle (not shown) that is inserted into the opening 399 on wheel mount 390. Rear wheels 374 and 376 are mounted for rotation about axis 379.

In the illustrated embodiment, the device 100 includes an axle holder 440 coupled to the bottom surface of seat portion 260. Axle holder 440 includes a sleeve 454 that includes a passageway 455 therethrough. The passageway 455 of the sleeve 454 is configured to receive the upper end 382 of the wheel mount 380.

The device 100 also includes another axle holder 400 that coupled to the bottom surface of seat portion 310. Axle holder 400 includes a sleeve 420 that includes a passageway 421 therethrough. The passageway 421 of the sleeve 420 is configured to receive the upper end 392 of the wheel mount 390.

The device 100 includes a pair of axle mounts 520 and 540. Axle mounts 520 and 540 support the wheel mounts 380 and 390, respectively, for rotation relative to the axle holders 440 and 400. Axle mount 520 is substantially cylindrical and is configured to be inserted into and supported within the passageway 455 of sleeve 454. Axle mount 520 includes a post 526. Similarly, axle mount 540 is substantially cylindrical and is configured to be inserted into the passageway 421 of sleeve 420. Axle mount 540 includes a post 546.

In the illustrated embodiment, the upper end 382 of the wheel mount 380 is releasably coupled to the axle mount 520. When coupled together, wheel mount 380 and axle mount 520 can rotate relative to sleeve 454 and axle holder 440.

The upper end 392 of the wheel mount 390 is releasably coupled to the axle mount 540. When coupled together, wheel mount 390 and axle mount 540 can rotate relative to sleeve 420 and axle holder 400.

The device 100 includes a pair of links 500 and 550. Links 500 and 550 are used to cause rotation of the axle mounts and wheel mounts as described in detail below.

Link 500 includes an opening 506 that is configured to receive the post 526 on the axle mount 520. Link 550 includes an opening 556 that is configured to receive the post 546 on the axle mount 540. Movement of one of the axle mounts 520 and 540 causes movement of the corresponding link 500 or 550. Similarly, movement of one of the links 500 and 550 causes movement of the corresponding axle mount 520 or 540.

Figure 13:
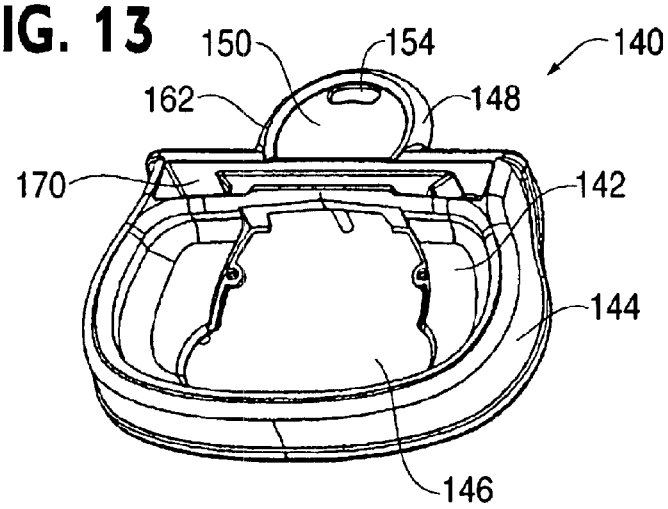
FIG. 13 illustrates a top perspective view of the upper housing of the device of FIG. 11.
Figure 14:
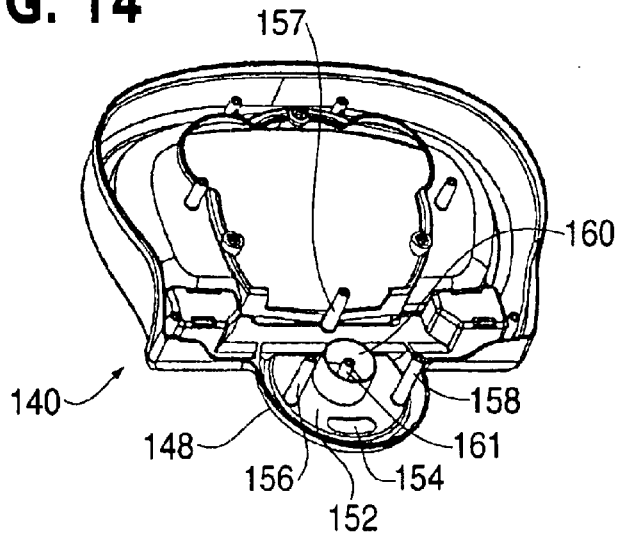
FIG. 14 illustrates a bottom perspective view of the upper housing of FIG. 13.

An embodiment of the upper housing 140 is illustrated in FIGS. 13 and 14. The opening 146 of the body 142 is sized and configured to allow balls placed by the child on the upper housing 140 to pass therethrough. The plate 148 includes an upper surface 150, a lower surface 152, and a curved perimeter 162. A slot 154 is formed in the plate 148 and extends between the upper surface 150 and the lower surface 152.

As illustrated in FIG. 14, the plate 148 includes several posts 156, 157, and 158 depending from its lower surface 152. The plate 148 also includes a central sleeve 160 on its lower surface 152. The central sleeve 160 includes an opening 161.

Figure 15:
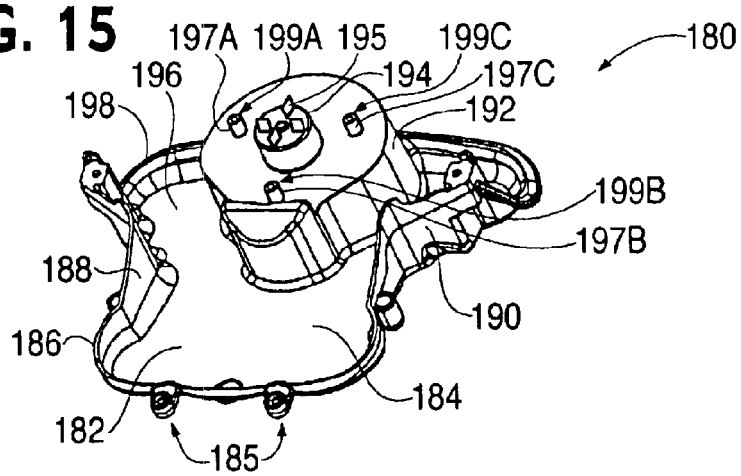
FIG. 15 illustrates a top perspective view of the lower housing of the device of FIG. 11.

An embodiment of the lower housing 180 is illustrated in FIG. 15. The lower housing 180 includes a plate 182 that has an upper surface 184 that is sloped downwardly from a front end to a back end of the lower housing 180. The plate 182 has a perimeter 186 and sidewalls 188 and 190 mounted on either side of the plate 182.

The plate 182 also includes retaining wall 198 that defines the retaining portion 196 as described above. When a child places a ball or other object in the upper housing 140, the ball travels downwardly along the upper surface 184 of the plate 182 to the retaining portion 196. The user of the device 100 can easily retrieve the object from the retaining portion 196 and repeatedly place the ball on the upper housing 140.

In the illustrated embodiment, the extension 194 includes several vertically oriented plates 195 located on its upper surface. As illustrated in FIG. 15, plates 195 are spaced approximately 90° apart. The extension 194 and plates 195 are configured to be inserted into the opening 161 formed in the central sleeve 160 on the upper housing 140.

The mount 192 includes an upper surface with three extensions 197A, 197B, and 197C projecting upwardly. Each of the extensions 197A, 197B, and 197C includes a corresponding opening 199A, 199B, and 199C.

Opening 199A is configured to receive post 156 on the lower surface of the upper housing. Similarly, openings 199B and 199C are configured to receive posts 157 and 158, respectively. In alternative embodiments, the location and number of posts on the upper housing and extensions on the lower housing can vary.

Figure 16:
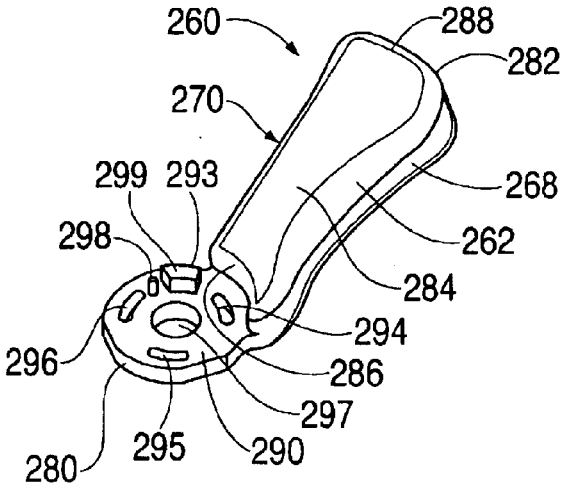
FIG. 16 illustrates a top perspective view of a seat portion of the device of FIG. 11.
Figure 17:
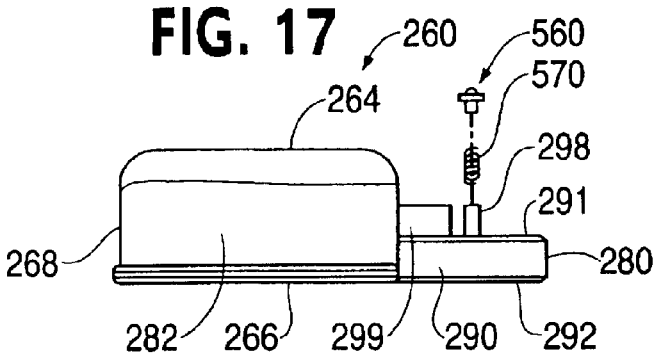
FIG. 17 illustrates an end view of the seat portion of FIG. 16.

An embodiment of the first seat portion 260 is illustrated in FIGS. 16 and 17. In this embodiment, the support portion 284 has a forward end 286 and a rearward end 288. The body 262 has a forward end 280, a rearward end 282, an upper surface 264, and a lower surface 266. The upper surface 264 is a generally planar surface. The body 262 includes an outer wall 268 and an inner wall 270 that extend around the perimeter of the body 262.

Coupling plate 290 is integrally formed with the support portion 284 and extends forwardly from end 286. Coupling plate 290 includes an upper surface 291 and a lower surface 292 and arcuate slots 294, 295, and 296 that extend from the upper surface 291 to the lower surface 292.

The post 298 and block 293 on the coupling plate 290 are located on the upper surface 291. As illustrated in FIG. 17, the lower surface 292 of the coupling plate 290 is in the same plane as the lower surface 266 of the body 262.

As discussed relative to FIG. 12, the button 560 and the spring 570 are illustrated in their respective positions relative to post 298 on coupling plate 290. The block 293 includes an upper surface 299 that provides a substantially planar surface. The lower surface of the coupling plate 340 of seat portion 310 slides along upper surface 299 when the seat portions 260 and 310 rotate relative to each other.

Figure 18:
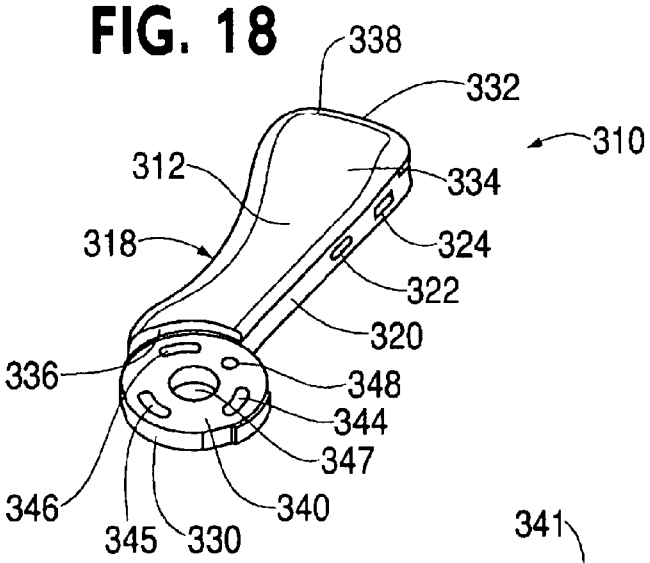
FIG. 18 illustrates a top perspective view of another seat portion of the device of FIG. 11.
Figure 19:
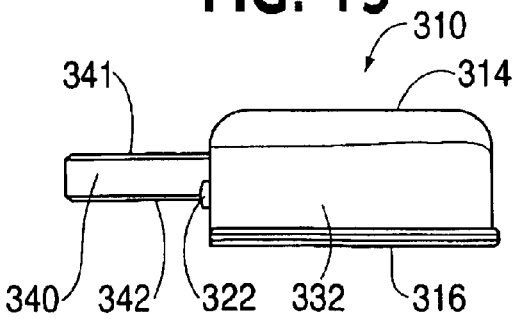
FIG. 19 illustrates an end view of the seat portion of FIG. 18.

An embodiment of the second seat portion 310 is illustrated in FIGS. 18 and 19. In this embodiment, the support portion 334 has a forward end 336 and a rearward end 338. The body 312 has a forward end 330, a rearward end 332, an upper surface 314, and a lower surface 316. The upper surface 314 is a generally planar surface. The body 312 includes an outer wall 318 and an inner wall 320 that extend around the perimeter of the body 312.

Coupling plate 340 is integrally formed with the support portion 334 and extends forwardly from end 336. Coupling plate 340 includes an tipper surface 341 and a lower surface 342 and arcuate slots 344, 345, and 346 that extend from the upper surface 341 to the lower surface 342. Coupling plate 340 also includes a recess 348, the purpose of which will be described in detail below.

The seat portion 310 includes an opening 324 in the inner wall 320. Link 550 extends out of and retracts into the opening 324. The seat portion 310 also includes a protrusion 322 formed on the inner wall 320. Protrusion 322 engages an opening formed in the inner wall 270 of seat portion 260 to align the seat portions 260 and 310 when they are positioned proximate to each other.

As illustrated in FIG. 19, the lower surface 342 of the coupling plate 340 is offset from the lower surface 316 of the body 312. In particular, the distance that lower surface 342 is offset from lower surface 316 is substantially the same amount as the height of the coupling plate 290 on seat portion 260. The offset coupling plates 290 and 340 of the seat portions 260 and 310 permits the upper surfaces of the seat portions to be level while the seat portions are pivotally mounted at a common point. When the components are assembled, the coupling plate 290 of seat portion 260 and coupling plate 340 of seat portion 310 are captured between the plate 148 of the tipper housing 140 and the mount 192 of the lower housing 180.

Figure 21:
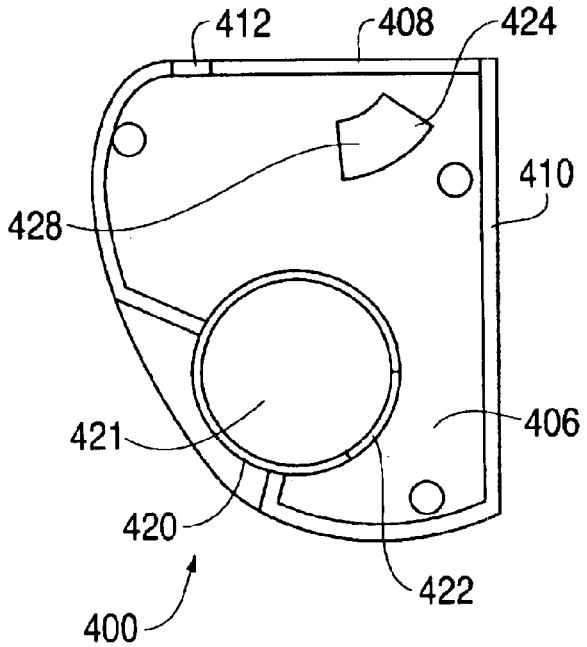
FIG. 21 illustrates a top view of the axle holder of FIG. 20.
Figure 22:
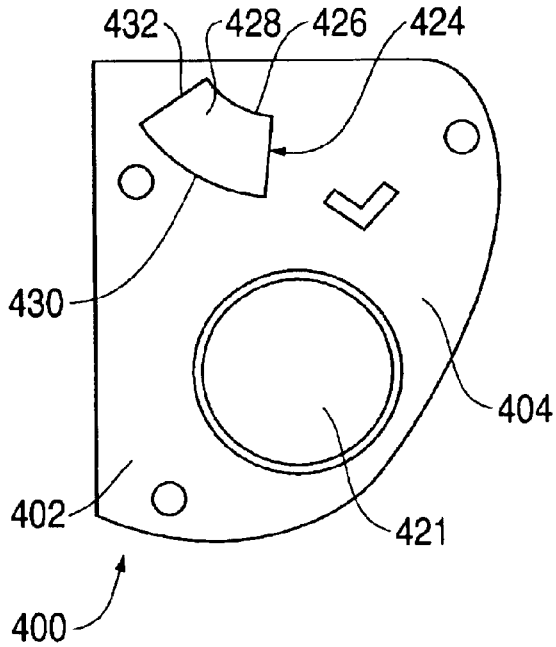
FIG. 22 illustrates a bottom view of the axle holder of FIG. 20.
Figure 20:
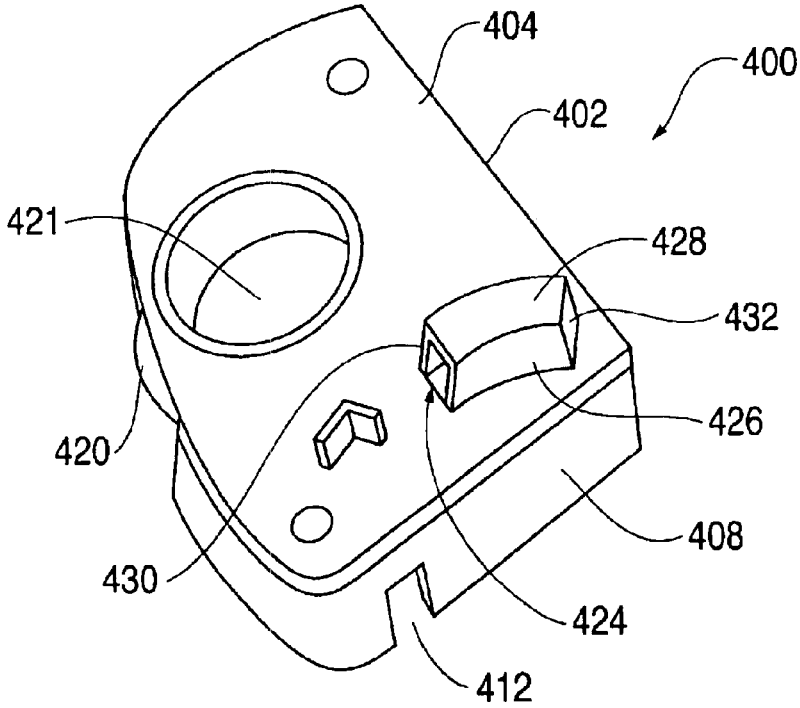
FIG. 20 illustrates a perspective view of an axle holder of the device of FIG. 11.

An embodiment of axle holder 400 is illustrated in FIGS. 20–22. Axle holder 400 includes a plate 402 that has a lower surface 404 and an upper surface 406. The axle holder 400 includes walls 408 and 410 extending upwardly from the upper surface 406. Wall 408 includes a recess 412 through which link 500 extends and retracts.

The sleeve 420 of the axle holder 400 is coupled to the plate 402. The sleeve 420 is a substantially cylindrical sleeve that includes a passageway 421 and a recess 422 located along a portion of the sleeve. In the illustrated embodiment, the recess 422 extends approximately 35° around the perimeter of the sleeve 420.

As illustrated in FIG. 20, the axle holder 400 includes a passageway 424 formed in the plate 402. The passageway 424 is defined by walls 426, 428, 430, and 432. The passageway 424 receives a latch or lock 480 when the seat portions 260 and 310 are in their riding configuration positions, as discussed in more detail with respect to FIGS. 43 and 44.

Figure 23:
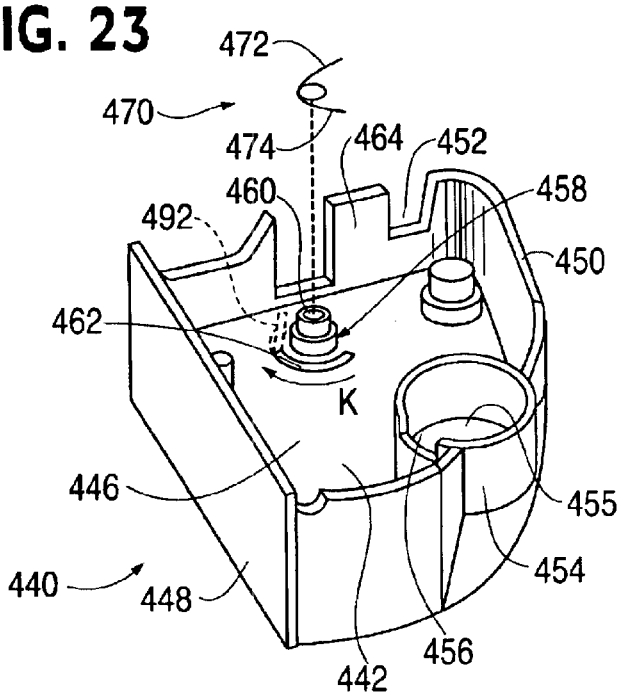
FIG. 23 illustrates a perspective view of another axle holder of the device of FIG. 11.
Figure 24:
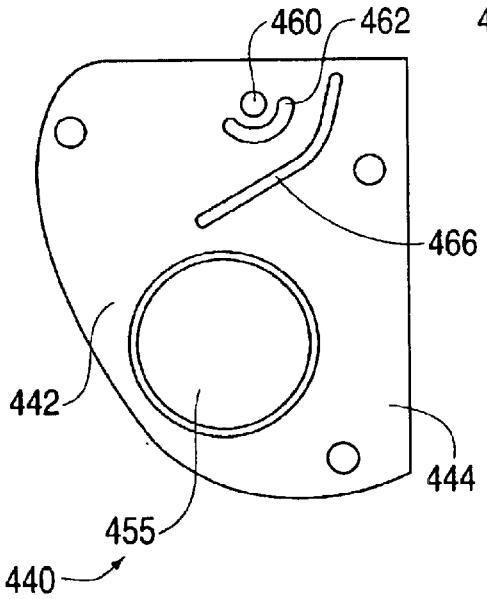
FIG. 24 illustrates a bottom view of the axle holder of FIG. 23.
Figure 25:
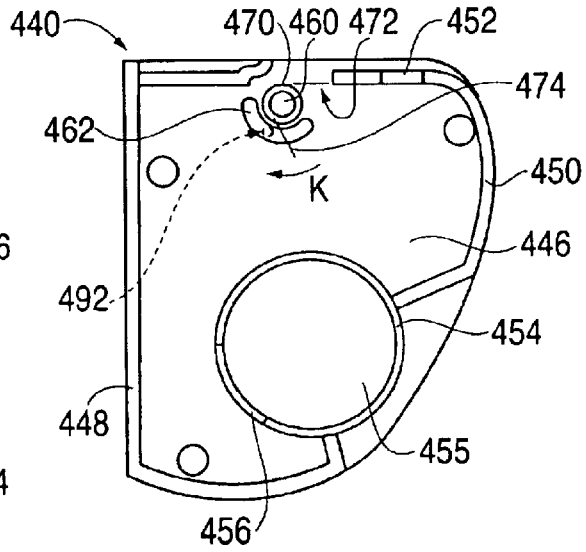
FIG. 25 illustrates a top view of the axle holder of FIG. 23.

An embodiment of axle holder 440 is illustrated in FIGS. 23–25. Axle holder 440 includes a plate 442 that has a lower surface 444 and an upper surface 446. The axle holder 440 includes walls 448 and 450 extending upwardly from the upper surface 446. Wall 450 includes a recess 452 through which link 500 extends and retracts. The plate 442 includes a contact wall 466 on its lower surface 444. The function of the contact wall 466 is described in detail below.

The sleeve 454 of the axle holder 440 is coupled to the plate 442. Sleeve 454 is similar to sleeve 420 and includes a passageway 455 and a recess 456 located along a portion of the sleeve. In the illustrated embodiment, the recess 456 extends approximately 35° around the perimeter of the sleeve 420.

The plate 442 includes a collar 458 on its upper surface 446 that has an opening 460 therethrough. A spring 470 is mounted on the collar 458. The plate 442 includes a slot 462 through which a shaft 492 of lock 480 extends when the lock 480 is mounted on the axle holder 440. The shaft 492 is illustrated in phantom in FIGS. 23 and 25 and in detail in FIG. 35. The operation of the lock 480 is discussed in detail relative to FIGS. 43 and 44.

The spring 470 includes ends 472 and 474. End 474 of the spring 470 contacts and biases the shaft 492 along the direction of arrow "K." The other end 474 of the spring 470 engages the inner surface 464 of wall 450. The lock 480 is normally biased along the direction of arrow "K" which corresponds to its locking position as described below.

Figure 26:
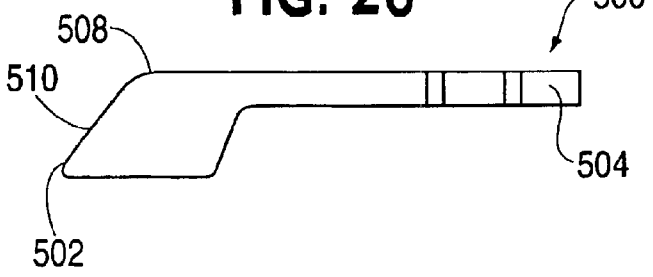
FIG. 26 illustrates a side view of a link of the device of FIG. 11.
Figure 27:
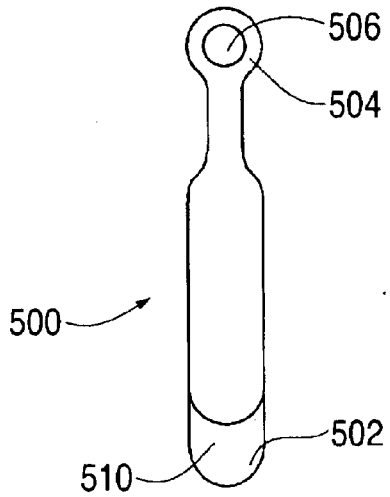
FIG. 27 illustrates a top view of the link of FIG. 26.

An embodiment of link 500 is illustrated in FIGS. 26 and 27. In this embodiment, link 500 is an elongate member with ends 502 and 504. Link 500 has an opening 506 defined proximate to end 504. The other end 502 of the link 500 includes a contact portion 508 with a tapered surface 510. Link 550 is structurally similar to link 500.

Figure 28:
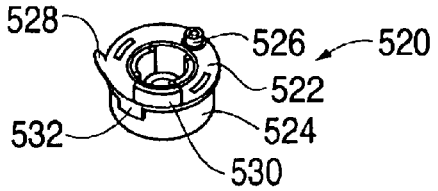
FIG. 28 illustrates a perspective view of an axle mount of the device of FIG. 11.
Figure 29:
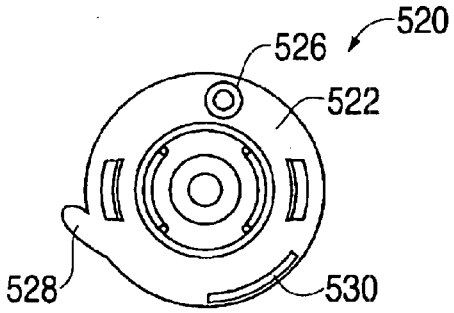
FIG. 29 illustrates a top view of the axle mount of FIG. 28.
Figure 30:
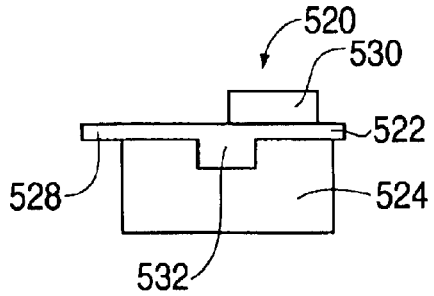
FIG. 30 illustrates a side view of the axle mount of FIG. 28.

An embodiment of axle mount 520 is illustrated in FIGS. 28–30. In this embodiment, axle mount 520 includes a ring 522 and a collar 524 depending from the ring 522. The upper surface of the ring 522 has a post 526 extending therefrom. As described above, post 526 engages opening 506 on link 500.

Axle mount 520 also includes a radial extension 528 and tabs 530 and 532. Tab 532 engages that notch or recess 422 formed in sleeve 420 of the axle holder 400. Since the width of tab 532 is less than the width of recess 422, the axle mount 520 is able to rotate while it is placed in the passageway of the sleeve 420. The extent of rotation of the axle mount 520 is limited to the range of movement of tab 532 in recess 422.

The structure of axle mount 540 is a mirror-image of the structure of axle mount 520. Accordingly, only axle mount 520 is discussed in detail for simplicity reasons only.

Figure 31:
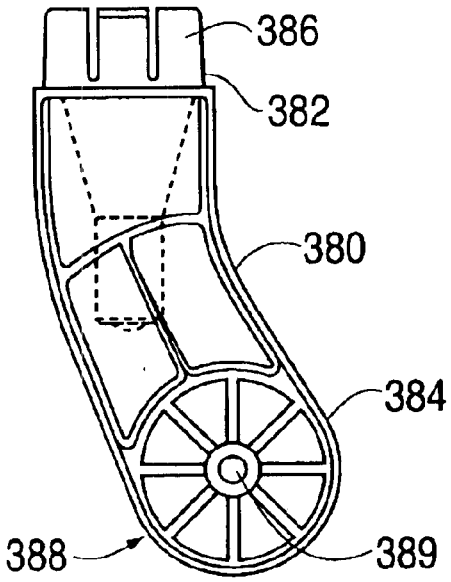
FIG. 31 illustrates a side view of a wheel mount of the device of FIG. 11.
Figure 32:
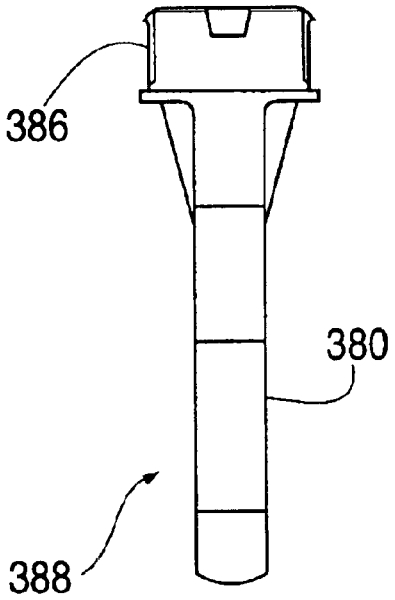
FIG. 32 illustrates an end view of the wheel mount of FIG. 31.

An embodiment of wheel mount 380 is illustrated in FIGS. 31 and 32. Wheel mount 380 includes an upper end 382 and a lower end 384. Proximate to upper end 382 are biased tabs 386 which engage with axle mount 420 to couple the wheel mount 380 and the axle mount 420 together. Wheel mount 380 also includes a mounting portion 388 that includes an axle opening 389. Wheel mount 390 is structurally similar to wheel mount 380.

Figure 33:
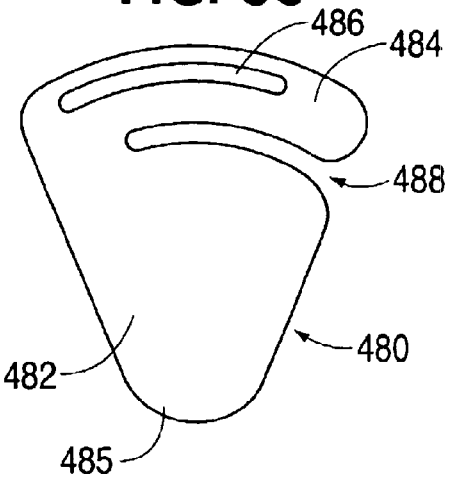
FIG. 33 illustrates a top view of the lock of the device of FIG. 11.
Figure 34:
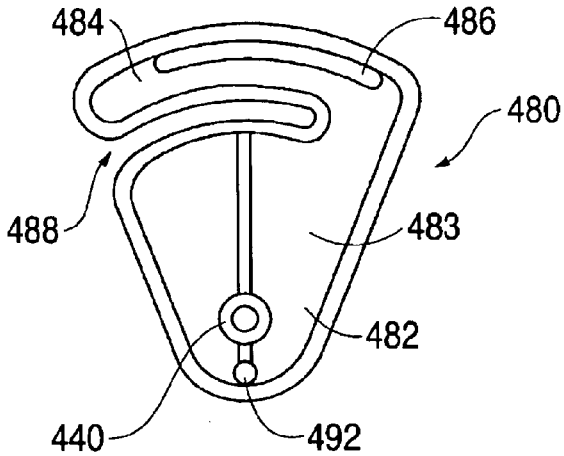
FIG. 34 illustrates a bottom view of the lock of FIG. 33.
Figure 35:
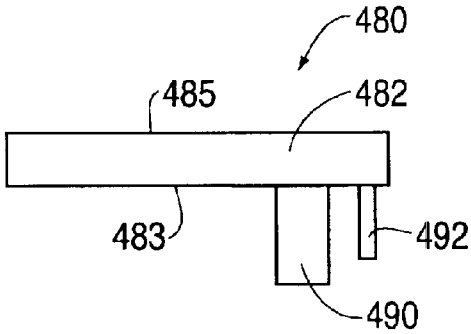
FIG. 35 illustrates a side view of the lock of FIG. 33.

An embodiment of lock 480 is illustrated in FIGS. 33–35. Lock 480 includes a body portion 482 and a locking portion 484 extending from the body portion 482. The body portion 482 and the locking portion 484 define a recess 488 therebetween. When the locking portion 484 is inserted into the passageway 424 of the axle holder 400, the wall 426 is received in recess 488. The locking portion 484 also includes a slot 486.

The body portion 482 includes an upper surface 485 and a lower surface 483. The lock 480 includes a pivot 490 and a shaft 492 extending downwardly from lower surface 483. The shaft 492 is inserted through the slot 462 of axle holder 440, as previously discussed.

Figure 36:
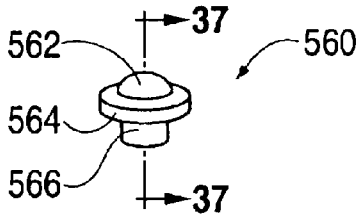
FIG. 36 illustrates a front perspective view of a button of the device of FIG. 11.
Figure 37:
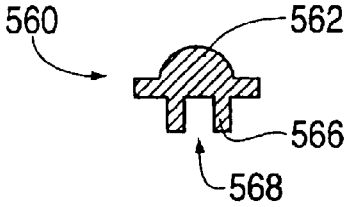
FIG. 37 illustrates a cross-sectional side view of the button of FIG. 36 taken along line "37—37" in FIG. 36.

An embodiment of button 560 is illustrated in FIGS. 36 and 37. Button 560 includes an upper end 562 and a lower end 566 and a flange 564 located therebetween. The spring 570 is mounted on the outer surface of the lower end 566. The lower end 566 includes an opening 568 into which extension 298 is inserted. The operation of button 560 is described in greater detail below.

Figure 38:
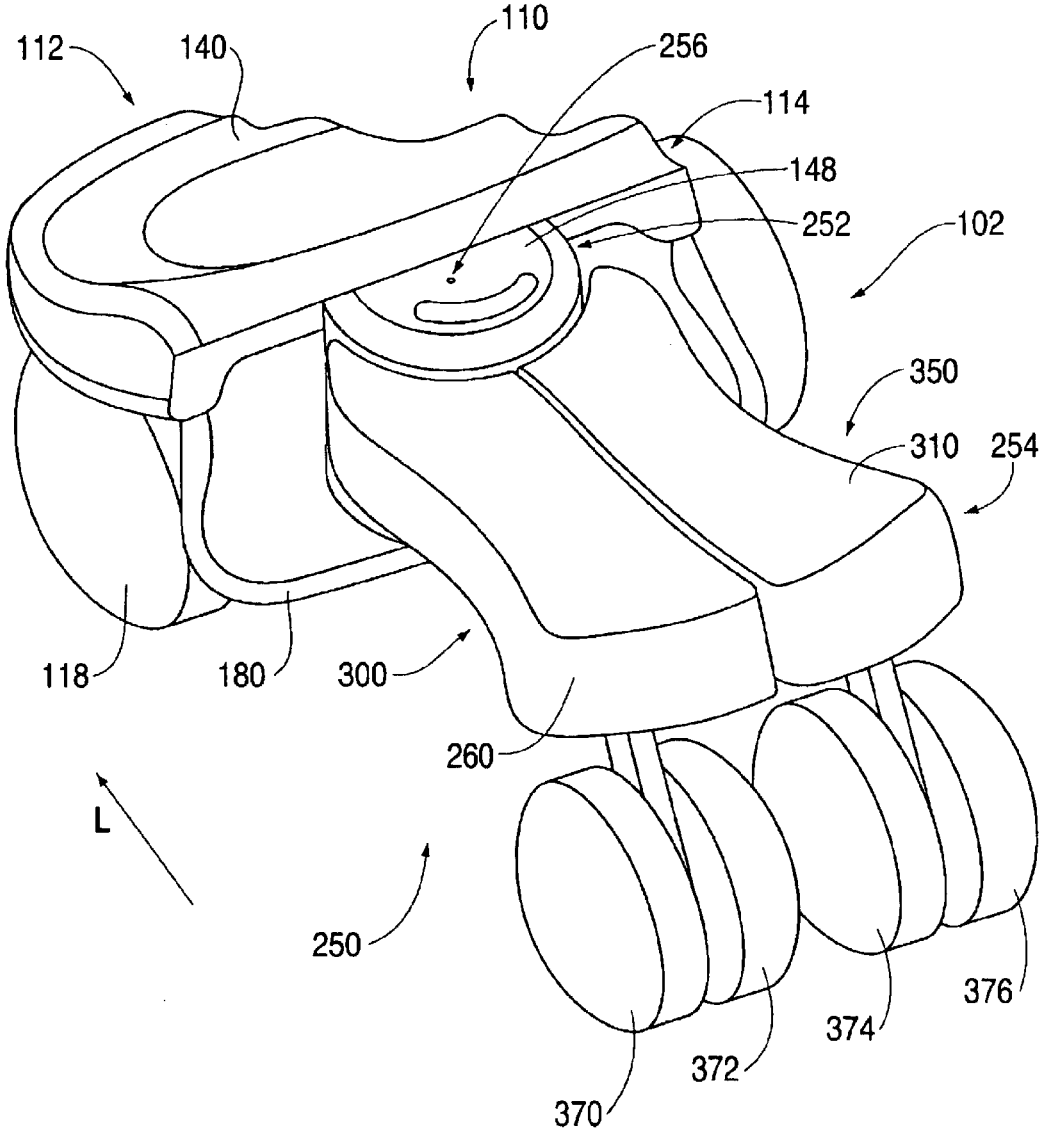
FIG. 38 illustrates a rear perspective view of some components of the device of FIG. 11 in a riding configuration.

Now the operation of the convertible walking and riding device 100 is discussed relative to FIGS. 38-44. A rear perspective view of the device 100 in a first or riding configuration 102 is illustrated in FIG. 38. Only some of the components of device 100 are illustrated. The upper housing 140 and lower housing 180 as well as the forward end 112 and rearward end 114 of the front portion 110 are illustrated. The forward end 252 and the rearward or back end 254 of the seat portion 250 are also identified.

In this configuration, seat portions 260 and 310 are adjacent to each other and form a seat on which a child may sit. Seat portion 260 is in its first position 300 and seat portion 310 is in its first position 350. When the seat portions 260 and 310 are in these positions, the longitudinal axes of the seat portions 260 and 310 are parallel to the direction of arrow "L." Rear wheels 370, 372, 374, and 376 are oriented for travel along the direction of arrow "L" and are aligned with the front wheels of the device 100. The device 100 may also travel backwards in the direction opposite to arrow "L."

The seat portions 260 and 310 are mounted for rotation in a generally horizontal plane about a pivot point 256 along plate 148. In this embodiment, pivot point 256 corresponds to the center of extension 194 on lower housing 180, about which seat portions 260 and 310 are rotatably mounted.

Figure 39:
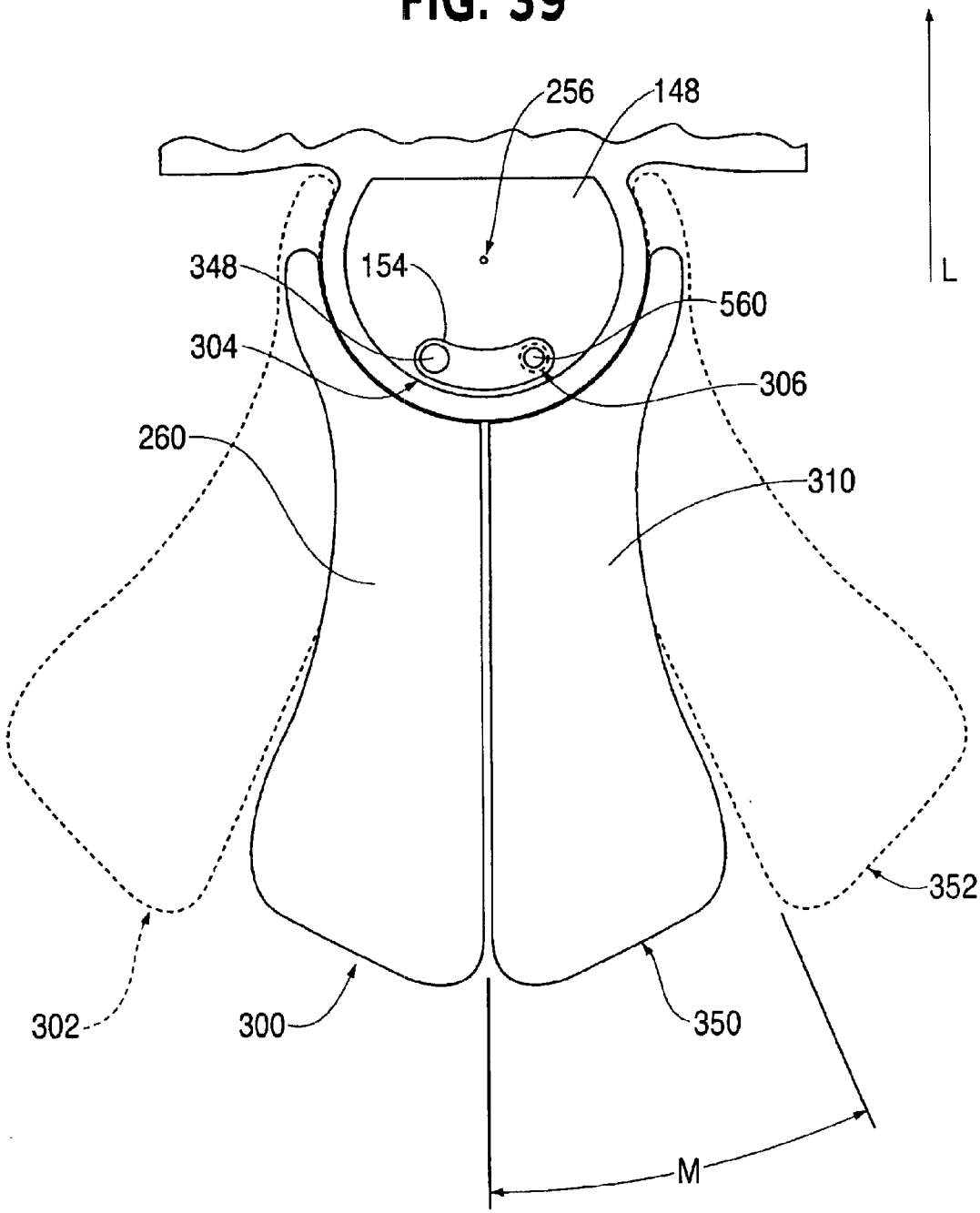
FIG. 39 illustrates a top view of some components of the device of FIG. 11 in a riding configuration and in a walking configuration.

Referring to FIG. 39, some of the relative positions of the seat portions 260 and 310 are illustrated. Seat portion 260 is movable between a first position 300 corresponding to the riding configuration 102 of the device 100 and a second position 302 (illustrated in phantom) corresponding to the walking or walker configuration 104 of the device 100. Similarly, seat portion 310 is movable between a first position 350 corresponding to the riding configuration 102 of the device 100 and a second position 352 (as illustrated in phantom) corresponding to the walking configuration 104 of the device 100.

When the seat portions 260 and 310 are in their first positions 300 and 302, they are disposed in the walking area 130. When the seat portions 260 and 310 are in their second positions 350 and 352, they are spaced laterally from the walking area 130.

In the illustrated embodiment, when one of the seat portions 260, 310 is rotated, the other seat portion simultaneously rotates in the opposite direction around the pivot point 256. Each of the seat portions 260, 310 rotates the same distance about the pivot point 256.

As discussed above, coupling plate 290 of seat portion 260 includes three arcuate slots 294, 295, and 296. Coupling plate 340 of seat portion 310 includes three arcuate slots 343, 345, and 346. In the illustrated embodiment, all of these slots have substantially the same length.

When the components of the device 100 are assembled, extension 197A and post 156 extend through slots 296 and 346. Extension 197B and post 157 extend through slots 295 and 345. Extensions 197C and post 158 extend through slots 294 and 344. Because the extensions and post are positioned within these slots, the range of rotation of the seat portions 260 and 310 is limited by length of these slots.

The angle that the seat portions 260 and 310 can rotate is represented by the angle "M" illustrated in FIG. 39. The angle "M" is determined by the length of the slots and can be varied depending on the desired width of the walking area 130 between the seat portions 260 and 310. In the illustrated embodiment, angle "M" is approximately 35°.

When seat portion 310 is in its riding position 350, the recess 348 on coupling plate 340 is aligned with slot 154 and is in its first position 304 illustrated in FIG. 39. When the seat portion 310 is moved to its walking position 352, the recess 348 moves to its second position 306 (illustrated in phantom). When the recess 348 is in position 306, the button 560 mounted on the extension 298 of coupling plate 290 is biased upwardly by spring 570 into engagement with the recess 348. When the upper end 562 of the button 560 engages the recess 348, the seat portions 260 and 310 are retained in their walking positions 302 and 352, respectively. The button 560 functions as a latch or lock to retain the device 100 in its walker or walking configuration 104.

When a user presses downwardly on the upper end 562 of the button 560, the button 560 disengages from recess 348 and the seat portions 260 and 310 can be moved toward each other.

Figure 40:
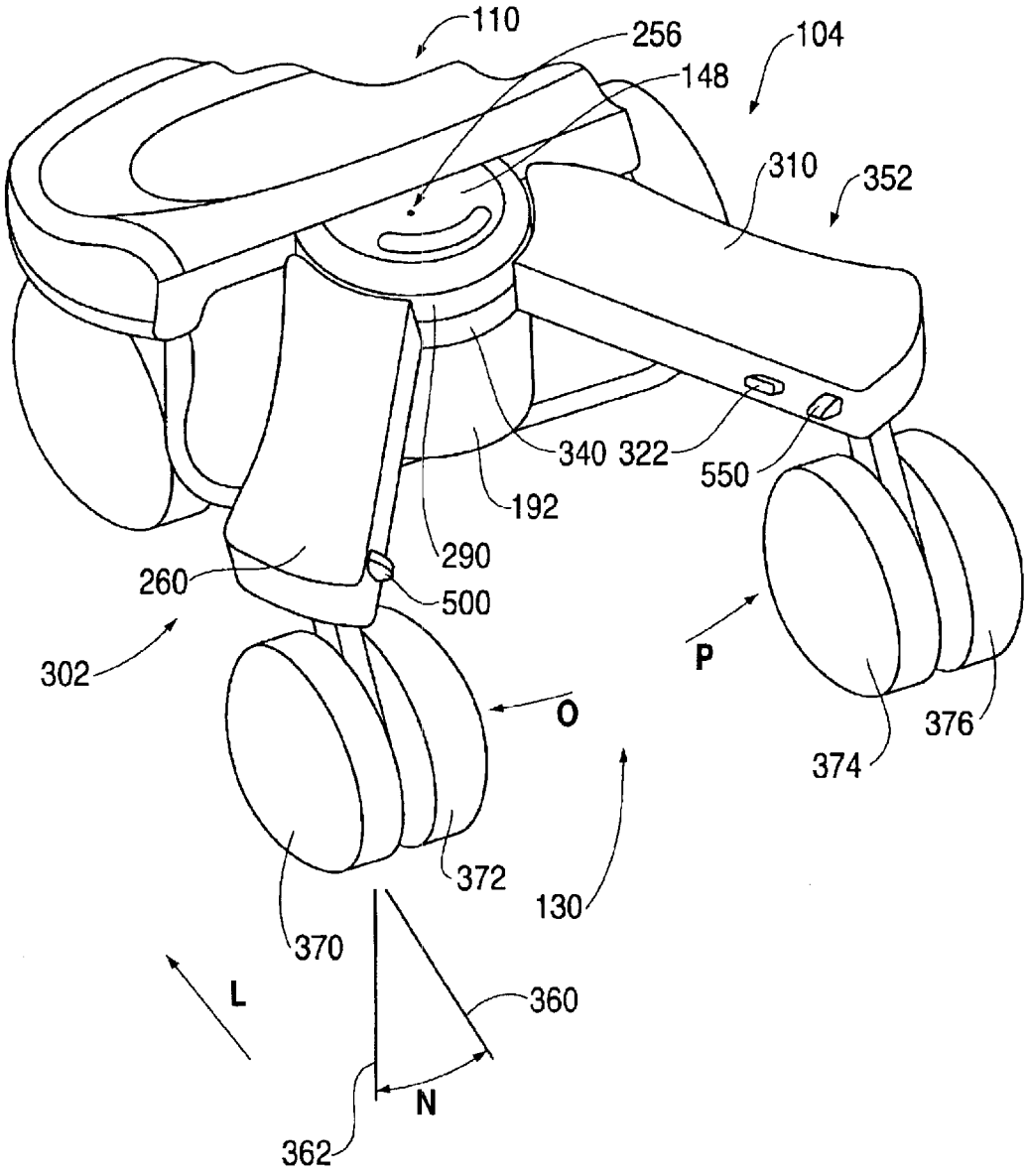
FIG. 40 illustrates a rear perspective view of some components of the device of FIG. 11 in a walking configuration.

The convertible walking and riding device 100 is illustrated in its walking configuration 104 in FIG. 40. In this configuration 104, the device 100 has a walking area or region 130 formed between the seat portions 260 and 310. As illustrated, the coupling plates 290 and 340 of the seat portions 260 and 310, respectively, are mounted between the plate 148 and the mount 192.

Seat portion 260 is rotated about pivot point 256 along the direction of arrow "O" to its walking position 302. Similarly, seat portion 310 is rotated about pivot point 256 along the direction of arrow "P" to its walking position 352. While the seat portions 260 and 310 are moved relative to the front portion 110, the rear wheels 370 and 372 rotate relative to seat portion 260 and rear wheels 374 and 376 rotate relative to seat portion 310. This rotation of the rear wheels is discussed in greater detail with respect to FIGS. 41 and 42.

Referring to FIG. 40, a line 362 extends along the longitudinal axis of seat portion 260 and a line 360 is aligned along the direction of travel of rear wheels 370 and 372. Together, lines 360 and 362 define an angle "N" therebetween. The angle "N" corresponds to and is the same as angle "M" (see FIG. 39) and represents the amount of angular movement or rotational movement of the seat portions 260 and 310 relative to the front housing 110. In other words, as seat portions 260 and 310 move along the directions of arrows "O" and "P," respectively, the rear wheels 370 and 372 rotate so as to maintain their alignment with the direction of movement of the device 100 along the direction of arrow "L."

Links 500 and 550 are movably mounted beneath seat portions 260 and 310. As illustrated in FIG. 40, links 500 and 550 extend from the inner walls of the seat portions 260 and 310 when the seat portions 260 and 310 are spaced apart. When the seat portions 260 and 310 are moved together, the links 500 and 550 engage each other and simultaneously push each other into their retracted positions beneath the seat portions 260 and 310.

Figure 41:
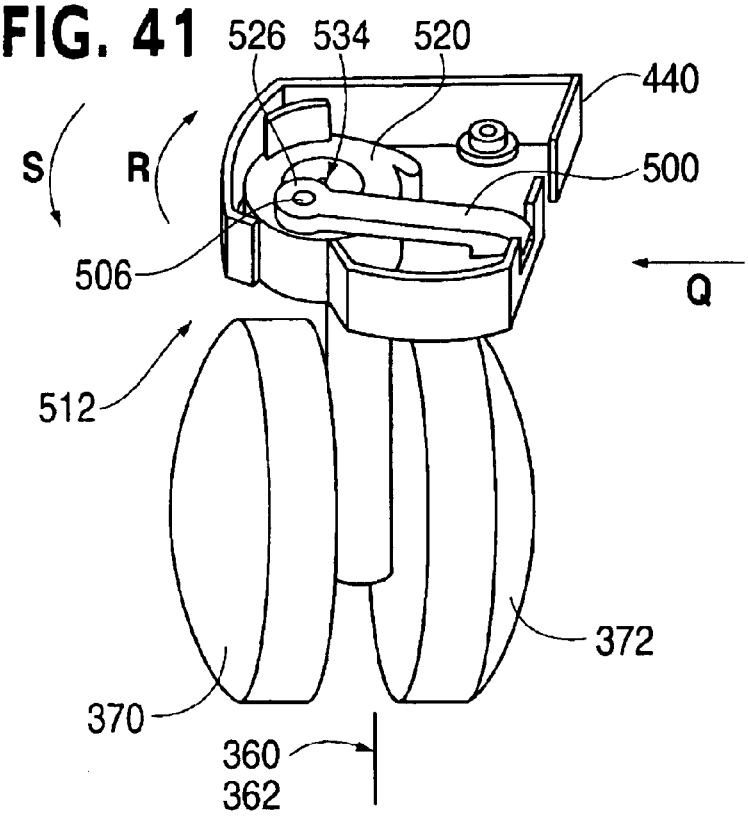
FIG. 41 illustrates a rear perspective view of some components of the seat portion of the device of FIG. 11 in positions corresponding to a riding configuration.
Figure 42:
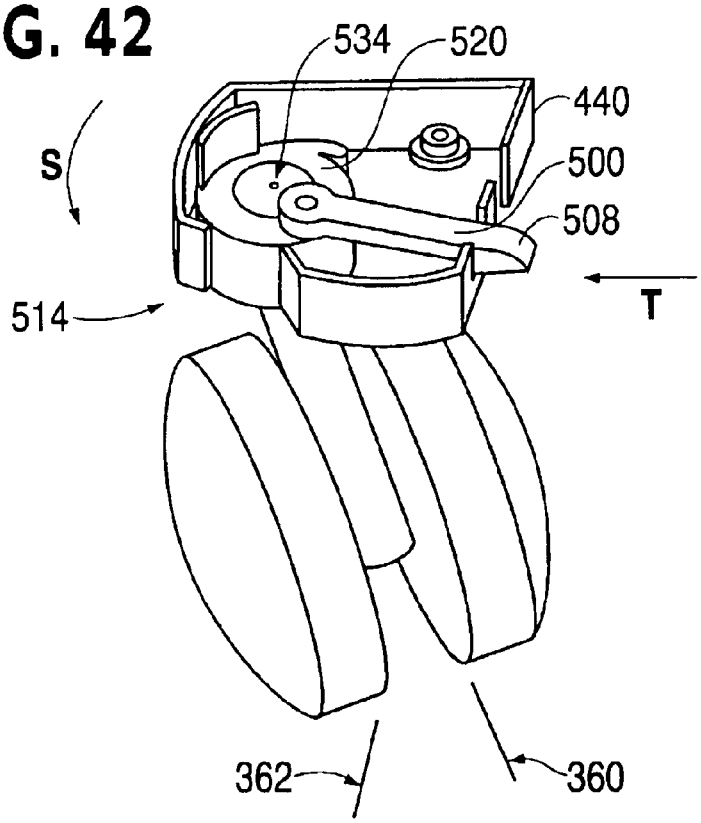
FIG. 42 illustrates a rear perspective view of the some components of the seat portion of the device of FIG. 11 in positions corresponding to a walking configuration.

Some components of the convertible device 100 are illustrated in FIGS. 41 and 42. In these figures, seat portion 260 is not illustrated, thereby allowing the internal components in axle holder 440 to be illustrated.

As discussed above, the upper end 382 of the wheel mount 380 is coupled to an axle mount 520 that is pivotally mounted within axle holder 440. Also, link 500 is coupled to the axle mount 520.

The components in FIG. 41 are illustrated in their respective positions corresponding to the riding configuration 102 of the device 100. In this configuration 102, the links 500 and 550 are engaging each other. When the links 500 and 550 engage each other, each link is forced to its retracted position beneath the corresponding seat portion 260 and 310. Link 500 is illustrated in its retracted position 512 in FIG. 41.

Link 500 is mounted on post 526 of axle mount 520. Axle mount 520 is biased by a spring (not shown) for rotation about pivot point 534 along the direction of arrow "S." The spring can engage tab 530 or extension 528 on the axle mount 520 to provide the biasing force.

When link 500 is pushed inwardly along the direction of arrow "Q," axle mount 520 rotates about pivot point 534 along the direction of arrow "R." The rotation of axle mount 520 causes wheel mount 380 to rotate about pivot point 534 in the same direction. When axle mount 520 rotates, rear wheels 370 and 372 and axis of rotation 378 also rotate about pivot point 534 with respect to seat portion 260 and are aligned with the longitudinal axis of the seat portion 260.

The components in FIG. 42 are illustrated in their respective positions corresponding to the walking configuration 104 of the device 100. In the walking configuration 104, the links 500 and 550 are not in engagement with each other. In this configuration, the axle mount 520 is biased for rotation about pivot point 534 along the direction of arrow "S."

When axle mount 520 rotates along the direction of arrow "S," link 500 moves along the direction of arrow "T" to its extended position 514. The rotation of axle mount 520 causes wheel mount 380 to rotate about the pivot point 534 in the same direction. Rear wheels 370 and 372 also rotate about pivot point 534 and are aligned with the direction of travel of the device 100 which corresponds to line 360. This structure and operation of the rear wheels ensures that the rear wheels automatically rotate to be aligned with the front wheels and with the direction of travel of the device 100 in any configuration of the device 100.

While the mounting and movement of rear wheels 370 and 372 and their associated components are discussed above relative to FIGS. 41 and 42, the mounting and movement of rear wheels 374 and 376 is a reverse-image of rear wheels 370 and 372. Accordingly, only rear wheels 370 and 372 are discussed in detail for simplicity reasons only.

Figure 43:
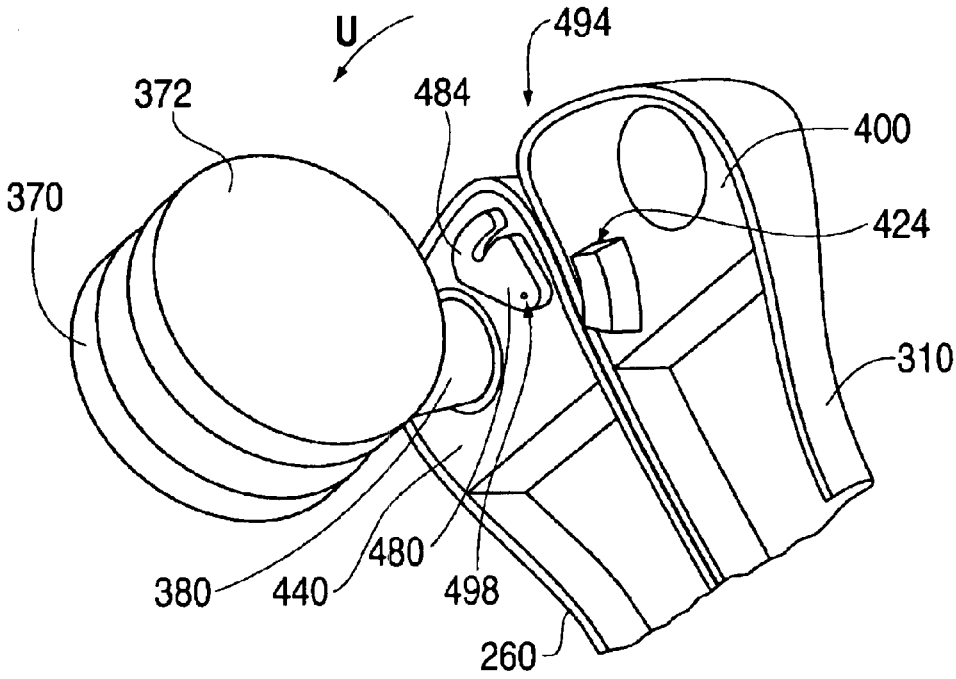
FIGS. 43 and 44 illustrate bottom perspective views of some components of the seat portion of the device of FIG. 11.
Figure 44:
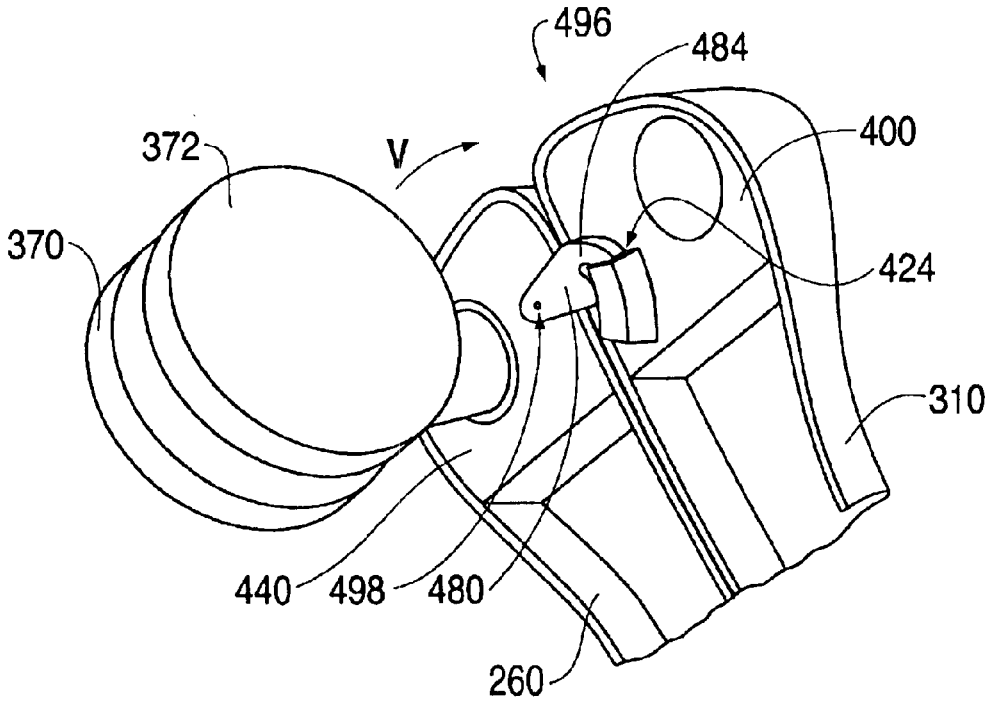

The operation of the locking mechanism of the convertible device 100 is discussed relative to FIGS. 43 and 44, which are bottom perspective views of the seat of the device 100. The seat portions 260 and 310 are illustrated in their riding positions in these figures. Rear wheels 374 and 376 are not illustrated for purposes of simplicity.

Referring to FIG. 43, lock 480 is coupled to the lower surface of axle holder 440. The lock 480 is selectively moveable between an unlocked position 494 (see FIG. 43) and a locked position 496 (see FIG. 44). When the lock 480 is in its unlocked position 494, the lock 480 is located completely beneath the seat portion 260.

As discussed with respect to FIGS. 23 and 25, spring 470 engages shaft 492 and biases lock 480 for rotation about pivot point 498 along the direction of arrow "U." The lock 480 can be manually rotated about pivot point 498 to its locked position 496 along the direction of arrow "V."

When the locking portion 484 of the lock 480 is inserted into passageway 424 on axle holder 400, the lock 480 is retained in its locked position 496 due to the structure of the lock 480 and the friction between the passageway walls and the locking portion 484. The engagement of lock 480 with passageway 424 prevents the seat portions 260 and 310 from separating when the device 100 is in its riding configuration 102. The lock 480 holds seat portions 260 and 310 together under the spring loads associated with the axle mounts 520 and 540. A user can press on a portion of the lock 480 adjacent to slot 486 to disengage the locking portion 484 of the lock 480 from the passageway 424.

While the components of the convertible device 100 are made of molded plastic, any suitable material that can support the weight of a child may be used.

In alternative embodiments, the particular configuration and shape of the link may vary.

In an alternative embodiment, the seat portions 260 and 310 can be mounted to the front portion 110 for laterally translating movement relative to the front portion 110 instead of rotational movement.

In an alternative embodiment, each seat portion 260 and 310 can be supported by a single rear wheel.

In alternative embodiments, the latch or lock may be placed on either seat portion to retain the seat portions in their positions proximate to each other. Alternatively, the latch or lock may be located on the front portion or chassis of the device. In this arrangement, the latch or lock may engage a passageway that is formed on one or both of the seat portions.

In an alternative embodiment, the device 100 may include only one of the seat portions 260 and 310.

Alternatively, any number of balls may be mounted on the handle or loosely associated with the front portion of the device.

While the invention has been described in detail and with reference to specific embodiments thereof, it will be apparent to one skilled in the art that various changes and modifications may be made therein without departing from the spirit and scope thereof. Thus, it is intended that the present invention covers the modifications and variations of this invention provided they come within the scope of the appended claims and their equivalents.

What is claimed is:

1. A toy comprising:

a body portion having a forward end and a rearward end, said body portion including a wheel rotatably mounted to said body portion for supporting said body portion on a supporting surface;

a walking area disposed behind said rearward end of said body portion; and a seat coupled to and extending from said rearward end of said body portion and movable between a first position in which said seat is disposed within said walking area and a second position in which said seat is spaced laterally from said walking area.

2. The toy of claim 1, further comprising:

a wheel rotatably mounted to said seat for supporting said seat on said supporting surface.

3. The toy of claim 1, said seat pivoting between said first position and said second position.

4. The toy of claim 1, said seat including a first seat portion having a wheel rotatably mounted thereto and a second seat portion having a wheel rotatably mounted thereto.

5. The toy of claim 1, further comprising:

a handle disposed on said body portion and extending upwardly from said body portion.

6. A convertible toy comprising:

a front portion having an upper surface and a lower surface and including a front wheel rotatably mounted to said lower surface for supporting said front portion on a supporting surface; and a first seat portion and a second seat portion pivotally coupled to said front portion, each of said first seat portion and said second seat portion including a rear wheel rotatably mounted to said first and second seat portions, said first and second seat portions being selectively movable between a first configuration in which said seat portions are disposed in spaced relation to each other and a second configuration in which said seat portions are disposed proximate to each other.

7. The convertible toy of claim 6, each of said first and second seat portions being coupled to said front portion for rotation, said first and second seat portions being disposed in said first configuration in an angularly spaced relation.

8. The convertible toy of claim 6, said front portion including a handle coupled to said front portion and extending upwardly therefrom.

9. The convertible toy of claim 6, said front portion including a pathway disposed on said upper surface and extending adjacent to said lower surface, said pathway having a retaining portion disposed at an end of said pathway adjacent said lower surface, said pathway configured for guiding an object from the upper surface to said retaining portion.

10. The convertible toy of claim 6, said front wheel having a rotation axis, said rotation axis being fixed with respect to said front portion.

11. The convertible toy of claim 6, each of said rear wheels having a rotation axis, said rotation axis being rotatable with respect to a respective one of said first and second seat portions.

12. The convertible toy of claim 6, further comprising:

a latch configured to releasably retain said first seat portion in one of said first configuration and said second configuration.

13. The convertible toy of claim 12, said latch being disposed on one of said front portion and said first seat portion.

14. The convertible toy of claim 5, further comprising:

a latch configured to releasably retain said first and second seat portions in one of said first configuration and said second configuration.

15. The convertible toy of claim 14, said latch being disposed on one of said front portion and said first and second seat portions.

16. A toy comprising:

a chassis having a pair of front wheels rotatably disposed on a forward end of said chassis; and a seat coupled to said chassis, said seat including a first seat portion and a second seat portion, said first seat portion and said second seat portion having a forward and a back end, said first seat portion and said second seat portion pivotally coupled at the forward end to said chassis about a pivot joint disposed on said chassis, said first seat portion and said second seat portion including a rear wheel rotatably mounted to said back end of said first and second seat portions, said first and second seat portions being selectively pivotable between a first configuration in which said seat portions are disposed in an angular spaced relation to each other and a second configuration in which said seat portions are disposed proximate to each other.

17. The toy of claim 16, said front wheels having a rotation axis, said rotation axis being fixed with respect to said chassis.

18. The toy of claim 16, each of said rear wheels having a rotation axis, said rotation axis being rotatable with respect to a respective one of said first and second seat portion.

19. The toy of claim 16, said chassis including an upper portion including a pathway disposed on said upper portion, said pathway including a retaining portion disposed at one end of said pathway, said pathway configured for guiding an object from said upper portion of said chassis to said retaining portion.

20. The toy of claim 16, further comprising:

a latch configured to releasably retain said first seat portion and said second seat portion in said first configuration and said second configuration.

21. The toy of claim 20, said latch being disposed on said chassis.

22. The toy of claim 20, said latch being disposed on one of said first and second seat portions.

23. A toy convertible between a walker configuration and a ride-on configuration, the toy comprising:

a body portion having an upper and a lower surface;

a pair of front wheels rotatably mounted on said lower surface of said body portion;

a seat including a first seat portion and a second seat portion, said first and second seat portions including a body having a lower surface, a generally planar upper surface, a rearward end, and a forward end pivotally coupled to said body portion; and a rear wheel rotatably mounted adjacent said rearward end and on said lower surface of said first seat portion and said second seat portion, said first and second seat portions being selectively engageable in the walker configuration, in which said seat portions are disposed in a spaced relation to each other thereby forming an area between said first and second seat portions in which a user can walk, and the ride-on configuration, in which said seat portions are disposed proximate to each other.

24. The toy of claim 23, said body portion including a handle disposed on said upper surface of said body portion and extending upwardly from said upper surface.

25. The toy of claim 23, said body portion including a container for receiving a plurality of objects and a pathway having a retaining portion disposed at one end of said pathway, said pathway configured for guiding an object from said upper surface of said body portion to said retaining portion.

26. The toy of claim 23, said front wheels being fixed in directional rotation with respect to said body portion.

27. The toy of claim 23, each of said rear wheels having a rotation axis, said rotation axis being rotatable with respect to said first and second seat portions.

28. The toy of claim 23, said first seat portion and said second seat portion being pivote in a generally horizontal plane about a pivot joint disposed on said body portion.

29. The toy of claim 23, further comprising:

a lock configured to releasably engage said first seat portion and said second seat portion in said walker configuration and said ride-on configuration.

30. The toy of claim 29, said lock being disposed on said body portion.

31. The toy of claim 29, said lock being disposed on said first and second seat portions.

* * * * *